US009440478B2

(12) United States Patent
Takahashi et al.

(10) Patent No.: US 9,440,478 B2
(45) Date of Patent: Sep. 13, 2016

(54) PAPER BINDING DEVICE, PAPER PROCESSING APPARATUS, IMAGE FORMING APPARATUS, AND IMAGE FORMING SYSTEM

(71) Applicants: Wataru Takahashi, Tokyo (JP); Nobuyoshi Suzuki, Tokyo (JP); Katsuhiro Kosuge, Kanagawa (JP); Hidehiko Fujiwara, Tokyo (JP); Makoto Hidaka, Tokyo (JP); Yuusuke Shibasaki, Kanagawa (JP); Takuya Morinaga, Tokyo (JP); Ryuji Yoshida, Kanagawa (JP)

(72) Inventors: Wataru Takahashi, Tokyo (JP); Nobuyoshi Suzuki, Tokyo (JP); Katsuhiro Kosuge, Kanagawa (JP); Hidehiko Fujiwara, Tokyo (JP); Makoto Hidaka, Tokyo (JP); Yuusuke Shibasaki, Kanagawa (JP); Takuya Morinaga, Tokyo (JP); Ryuji Yoshida, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 63 days.

(21) Appl. No.: 14/477,171

(22) Filed: Sep. 4, 2014

(65) Prior Publication Data

US 2015/0093214 A1 Apr. 2, 2015

(30) Foreign Application Priority Data

Sep. 30, 2013 (JP) ..... 2013-203080

(51) Int. Cl.
*B42B 5/00* (2006.01)
*B31F 1/07* (2006.01)
(Continued)

(52) U.S. Cl.
CPC . *B42B 5/00* (2013.01); *B31F 1/07* (2013.01); *B31F 5/02* (2013.01); *B42F 3/003* (2013.01); *B31F 2201/00* (2013.01); *B65H 2301/51616* (2013.01); *G03G 2215/00852* (2013.01)

(58) Field of Classification Search
CPC ..... B31F 1/07; B31F 5/02; B31F 2201/00; B65H 2301/51616; B42F 3/003; G03G 2215/00852
USPC ..... 270/58.07, 58.08; 399/408
See application file for complete search history.

(56) References Cited

U.S. PATENT DOCUMENTS 1,130,595 A * 3/1915 Hawkins ..... B31F 5/027 493/351

(Continued)

FOREIGN PATENT DOCUMENTS

CN 101503157 A 8/2009
CN 101920869 A 12/2010

(Continued)

OTHER PUBLICATIONS

Office Action for corresponding Chinese application No. 201410490682.9 dated Nov. 4, 2015 and English translation thereof.

*Primary Examiner* — Leslie A Nicholson, III
(74) *Attorney, Agent, or Firm* — Harness, Dickey & Pierce, P.L.C.

(57) ABSTRACT

A paper binding device comprises: a pair of binding members that has a pair of teeth portions, and presses to bind a bundle of paper sheets; a moving unit that causes one of the pair of binding members to move along with the other of the pair of binding members between a binding position at which the bundle of paper sheets is bound and a retracted position; a separating unit that moves coordinating with movement of the one of the pair of binding members, and when the one of the pair of binding members moves from the binding position to the retracted position, that contacts with the bundle of the paper sheets and causes the bundle of paper sheets to separate from the one of the pair of binding members; and a restricting member that stops the separating unit at a restricting position between the binding position and the retracted position, when the one of the pair of the binding members moves from the binding position to the retracted position.

19 Claims, 17 Drawing Sheets

(51) Int. Cl.
*B31F 5/02* (2006.01)
*B42F 3/00* (2006.01)

(56) References Cited

U.S. PATENT DOCUMENTS 5,697,747 A * 12/1997 Sawada ..... B42C 9/0056 412/16
8,061,701 B2 11/2011 Iguchi et al.
8,177,211 B2 5/2012 Iguchi et al.
8,246,033 B2 * 8/2012 Sato ..... B42C 1/12 270/58.07
8,286,958 B2 10/2012 Suzuki et al.
8,297,610 B2 * 10/2012 Shiraishi ..... B65H 37/04 270/58.08
8,413,979 B2 * 4/2013 Sato ..... B65H 37/04 270/58.07
2007/0286705 A1 12/2007 Sasamoto et al.
2009/0200724 A1 8/2009 Iguchi et al.
2010/0310340 A1 12/2010 Suzuki et al.
2013/0214471 A1 8/2013 Yabe
2013/0264762 A1 10/2013 Matsushita et al.
2013/0270762 A1 10/2013 Saito et al.
2013/0300050 A1 11/2013 Suzuki et al.
2014/0138896 A1 5/2014 Yoshida et al.
2014/0151951 A1 6/2014 Shibasaki et al.
2014/0219747 A1 8/2014 Takahashi et al.

FOREIGN PATENT DOCUMENTS

CN 103287131 A 9/2013
JP 2010-184769 8/2010
JP 2014-121865 A 7/2014

* cited by examiner

PAPER BINDING DEVICE, PAPER PROCESSING APPARATUS, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2013-203080 filed in Japan on Sep. 30, 2013.

BACKGROUND OF THE INVENTION

1. Field of the Invention

The present invention relates to a paper binding device that performs a binding operation with respect to paper sheets; a paper processing apparatus that includes the paper binding device; an image forming apparatus that includes the paper binding device; and an image forming system that includes the paper binding device.

2. Description of the Related Art

A conventional image forming system is known in which a paper processing apparatus includes a paper binding device that performs a binding operation with respect to a bundle of paper sheets on which images have been formed by an image forming apparatus.

In Japanese Patent Application Laid-open no. 2010-184769, a pressure-bonding-type paper binding device is disclosed that implements a pressure-bonding binding method in which strong engagement of a bundle of paper sheets is achieved without the use of metallic needles but with the use of pressure-bonding teeth portions that are pressure-bonding members forming a pair of uneven teeth portions. As a result, the paper fiber of the paper sheets gets tangled, and the bundle of paper sheets gets bound by means of pressure-bonding of the paper sheets.

In this paper binding device, one of the pair of pressure-bonding teeth portions is a fixed pressure-bonding teeth portion assembled to a fixed member, and the other is a movable pressure-bonding teeth portion that is assembled on a movable member which is detachably attachable to the pressure-bonding member assembled to the fixed member.

As a result of binding a bundle of paper sheets by means of pressure-bonding binding instead of using metallic needles, the time and effort required for removing metallic needles from the bundle of paper sheets can be saved at the time of discarding or strip-shredding the bundle of paper sheets.

However, when a bundle of paper sheets is to be strongly engaged using the pair of pressure-bonding teeth portions, it is necessary to apply a strong pressure force. Hence, while releasing the engagement of the pair of pressure-bonding teeth with respect to the bundle of paper sheets, there are times when the bundle of paper sheets that has been subjected to pressure-bonding binding sticks to the movable pressure-bonding teeth portion and moves in the direction in which the movable pressure-bonding teeth portion moves away from the fixed pressure-bonding teeth portion. In case a bundle of paper sheets sticks to the movable pressure-bonding teeth portion, it may cause paper jam and damage to the paper sheets.

In view of the issues mentioned above, there is a need to provide a paper binding device in which a bundle of paper sheets that has been subjected to paper-binding bonding can be prevented from sticking to the movable paper-bonding member; to provide a paper processing apparatus that includes the paper binding device; to provide an image forming apparatus that includes the paper binding device; and to provide an image forming system that includes the paper binding device.

SUMMARY OF THE INVENTION

It is an object of the present invention to at least partially solve the problems in the conventional technology.

According to the present invention, there is provided a paper binding device comprising: a pair of binding members that has a pair of teeth portions, and presses to bind a bundle of paper sheets; a moving unit that causes one of the pair of binding members to move along with the other of the pair of binding members between a binding position at which the bundle of paper sheets is bound and a retracted position; a separating unit that moves coordinating with movement of the one of the pair of binding members, and when the one of the pair of binding members moves from the binding position to the retracted position, that contacts with the bundle of the paper sheets and causes the bundle of paper sheets to separate from the one of the pair of binding members; and a restricting member that stops the separating unit at a restricting position between the binding position and the retracted position, when the one of the pair of the binding members moves from the binding position to the retracted position.

The present invention also provides an image forming apparatus comprising: an image forming unit that forms an image on a paper sheet; and a paper binding device that performs a binding operation with respect to a bundle of paper sheets on which the image forming unit has formed an image, wherein the paper binding device is the paper binding device mentioned above.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12 is an operational explanatory diagram illustrating a state in which, from the state illustrated in FIG. 11, the second paper sheet has been carried in;

DETAILED DESCRIPTION OF THE PREFERRED EMBODIMENTS

First Embodiment

Figure 2:
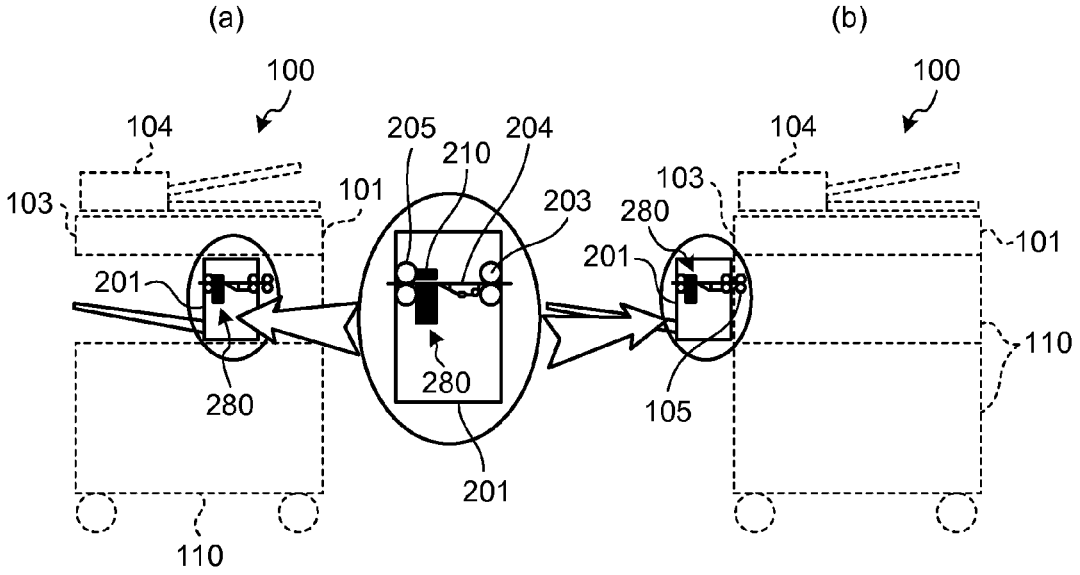
FIG. 2 is a diagram illustrating two modes of an image forming system according to a first embodiment.

FIG. 2 is a diagram illustrating modes of an image forming apparatus and an image forming system according to a first embodiment. In FIG. 2, (a) illustrates an image forming system 100 having a paper post-processing apparatus 201, which is a paper processing apparatus, installed in the carrying path of the image forming apparatus 101. In contrast, in FIG. 2, (b) illustrates an image forming system 100 that includes the image forming apparatus 101 and includes the paper post-processing apparatus 201 that is installed on the outside of the carrying path of the image forming apparatus 101.

The paper post-processing apparatus 201 includes a pressure-bonding binding device 280 that is a paper binding device used in binding the paper sheets that have been discharged from the image forming apparatus 101. The paper post-processing apparatus 201 has a matching function for the purpose of stacking and matching the paper sheets in the carrying path and has a binding function for the purpose of binding the bundle of matched paper sheets in the carrying path.

With reference to (a) in FIG. 2, the paper post-processing apparatus 201 is also called an in-body processing device because it performs post-processing inside the body of the image forming apparatus 101. In this way, the paper post-processing apparatus 201 according to the first embodiment is compact and, depending on the configuration of the image forming apparatus 101, can be easily installed inside the body or disposed on a lateral side of the image forming apparatus 101.

The image forming apparatus 101 includes an image forming engine unit 110 that has an image processing unit and a paper feeding unit; a reading engine unit 103 that reads an image and converts it into image data; and an automatic document feeder 104 that automatically feeds the originals to be read by the reading engine unit 103.

With reference to (a) in FIG. 2, a paper sheet on which an image has been formed is discharged by a paper discharging unit disposed inside the body of the image forming apparatus 101. In contrast, with reference to (b) in FIG. 2, a paper sheet on which an image has been formed is discharged by a paper discharging unit 105 disposed on the outside of the image forming apparatus 101.

Figure 3:
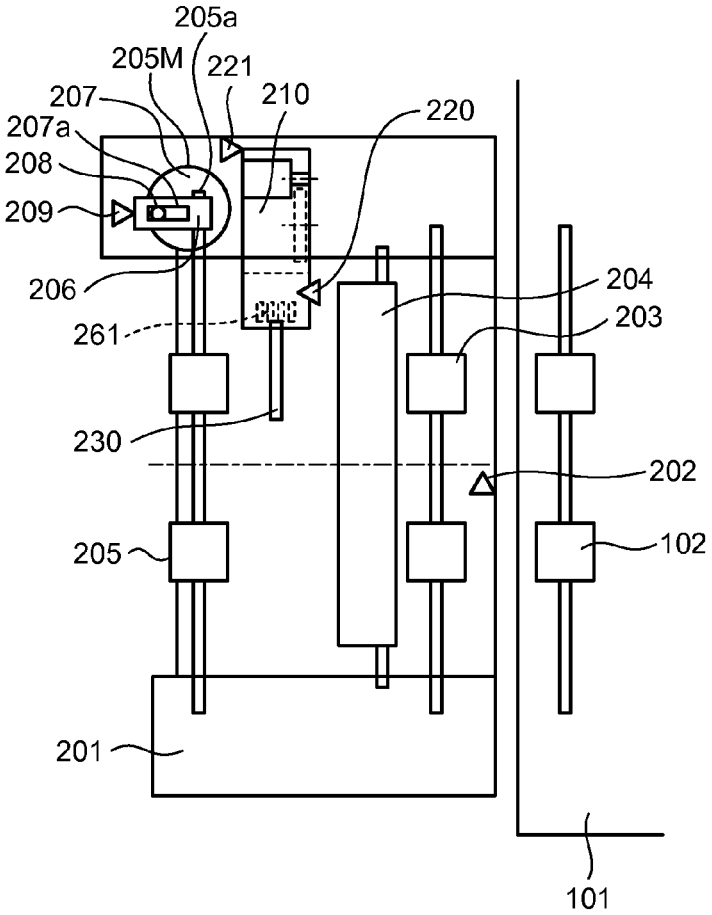
FIG. 3 is a planar view of a paper post-processing apparatus illustrated in FIG. 2.
Figure 4:
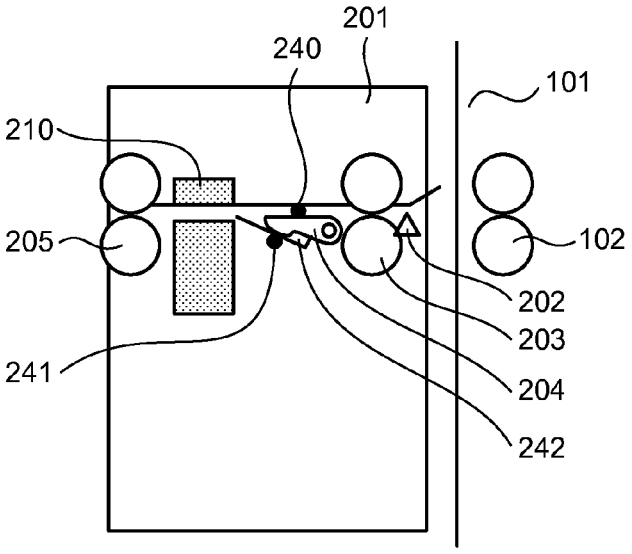
FIG. 4 is a front view of the paper post-processing apparatus illustrated in FIG. 2.

FIG. 3 is a planar view of the paper post-processing apparatus 201 illustrated in FIG. 2. FIG. 4 is a front view of the paper post-processing apparatus 201 illustrated in FIG. 2. With reference to FIGS. 3 and 4, the paper post-processing apparatus 201 includes an entry sensor 202, an entry roller 203, a bifurcating claw 204, a binding implement 210, and a discharge roller 205 disposed in that order from the entry side along a carrying path 240.

The entry sensor 202 detects the leading end, the rear end, and the presence or absence of a paper sheet that has been discharged from a discharge roller 102 of the image forming apparatus 101 and carried to the paper post-processing apparatus 201. As the entry sensor 202, it is possible to use, for example, a reflective optical sensor. Alternatively, instead of a reflective optical sensor, it is also possible to use a transmission-type optical sensor.

The entry roller 203 is positioned at the entrance to the paper post-processing apparatus 201; receives a paper sheet discharged by the discharge roller 102 of the image forming apparatus 101; and carries that paper sheet to the binding implement 210 functioning as a binding unit of the pressure-bonding binding device 280. Meanwhile, a driving unit (a driving motor) (not illustrated) is disposed that is capable of controlling the stoppage, rotation, and the amount of carry of the entry roller 203. Moreover, a post-processing control unit (not illustrated) is also disposed that controls the driving unit and the pressure-bonding binding device 280.

The leading end of the paper sheet, which is carried from the side of the image forming apparatus 101, butts against the nip formed between the entry roller 203 and a pairing roller, and is subjected to skew correction.

The bifurcating claw 204 is disposed at the subsequent stage of the entry roller 203. The purpose of disposing the bifurcating claw 204 is to guide the rear end of the paper sheet to a bifurcating path 241. In this case, after the rear end of the paper sheet passes by the bifurcating path 241, the bifurcating claw 204 rotates in the clockwise direction with reference to FIG. 4 and carries the paper sheet in the opposite direction to the carrying direction.

As a result, the rear end of the paper sheet is guided toward the bifurcation path 241. Although described later, the bifurcating claw 204 is driven using solenoid and performs an oscillating action. Meanwhile, instead of using solenoid, it is also possible to use a motor.

The bifurcating claw 204 is driven in the counterclockwise direction with reference to FIG. 4. While rotating, the bifurcating claw 204 can press a paper sheet or a bundle of paper sheets on the carrying surface of the bifurcating path 241. Thus, using the bifurcating claw 204, a paper sheet or a bundle of paper sheets can be fixed in the bifurcating path 241.

The discharge roller 205 is positioned immediately before the exit in the last stage of the carrying path 240 in the paper post-processing apparatus 201; and has the functions of carrying, shifting, and discharging paper sheets. In an identical manner to the case of the entry roller 203, a driving unit (a driving motor) (not illustrated) is disposed that is capable of controlling the stoppage, rotation, and the amount of carry of the discharge roller 205. Moreover, the driving unit is controlled by the post-processing control unit mentioned above. Herein, shifting of the discharge roller 205 is performed by a shift mechanism 205M that is configured with a shift link 206, a shift cam 207, a shift cam stand 208, and a shift home-position sensor 209.

The shift link 206 is disposed on an axial end 205*a* of the discharge roller 205, and receives movement force of the shift. The shift cam 207 includes the shift cam stand 208 and is a disc-shaped rotatable component. Due to the rotation of the shift cam 207, the discharge roller 205 that has been movably inserted into a shift-link long hole 207*a* via the shift cam stand 208 moves in the orthogonal direction to the paper carrying direction. This movement represents, what is called, the shift.

The shift cam stand 208 has a function of coordinating with the shift-link long hole 207*a* and converting the rotational movement of the shift cam 207 into a linear movement in the axial direction of the discharge roller 205. The shift home-position sensor 209 detects the position of the shift link 206. The position detected by the shift home-position sensor 209 is set as the home position, and the rotation control of the shift cam 207 is performed with reference to the home position. Herein, this control is performed by the post-processing control unit mentioned above.

The binding implement 210 includes a paper end detecting sensor 220, a binding-implement home position sensor 221, and a guide rail 230 for enabling the binding implement movement. The binding implement 210 is a mechanism for binding a bundle PB of paper sheets and represents, what is called, a stapler.

In the first embodiment, the configuration is such that paper sheets are sandwiched and pressured between a pair of tooth forms 261. As a result, the paper sheets get deformed and are bound together due to tangling of the paper fiber.

Aside from this binding method, there are known staplers in which the binding implement performs half blanking, lancing, or lancing followed passing through a hole.

In any case, the binding implement 210 enables achieving reduction in the supply consumption or enables easier recycling and makes it possible to strip-shred the paper sheets as they are. Hence, the binding implement 210 makes a huge contribution to resource saving. Hence, using the binding implement 210, it becomes possible to perform a binding operation such as pressure binding for paper sheets without using metallic needles in a paper post-processing apparatus that represents, what is called, a finisher.

The paper end detecting sensor 220 detects the side edges of the paper sheets. Thus, while aligning the paper sheets, the alignment is done with reference to the detected positions.

The binding-implement home position sensor 221 detects the position of the binding implement 210 that is movable in the paper width direction. Herein, such a position of the binding implement 210 which does not come in the way of carrying paper sheets of the largest size is set as the home position. Thus, the binding-implement home position sensor 221 detects the home position.

The guide rail 230 guides the movement of the binding implement 210 in such a way that the binding implement can move in a stable manner in the paper width direction. The guide rail 230 is disposed in such a way that, starting from the home position to the position at which paper sheets of the smallest paper size can be bound, the binding implement 210 can move in the orthogonal direction to the paper carrying direction of the carrying path 240 of the paper post-processing apparatus 201.

Meanwhile, the binding implement 210 is moved along the guide rail 230 by a movement mechanism including a driving motor (not illustrated).

The carrying path 240 is used to carry the paper sheets that have been received and discharge them; and is laid to run through from the entry side to the exit side of the paper post-processing apparatus 201. The bifurcating path 241 is used to invert (switch back) the paper sheets and carry them from the rear end side; and is laid in a bifurcating manner from the carrying path 240. The bifurcating path 241 is laid for the purpose of stacking and matching the paper sheets, and serves as a piling unit.

A butting surface 242 is formed at the extremity of the bifurcating path 241, and serves as a reference surface against which the rear ends of paper sheets are butted for matching.

Figure 1:
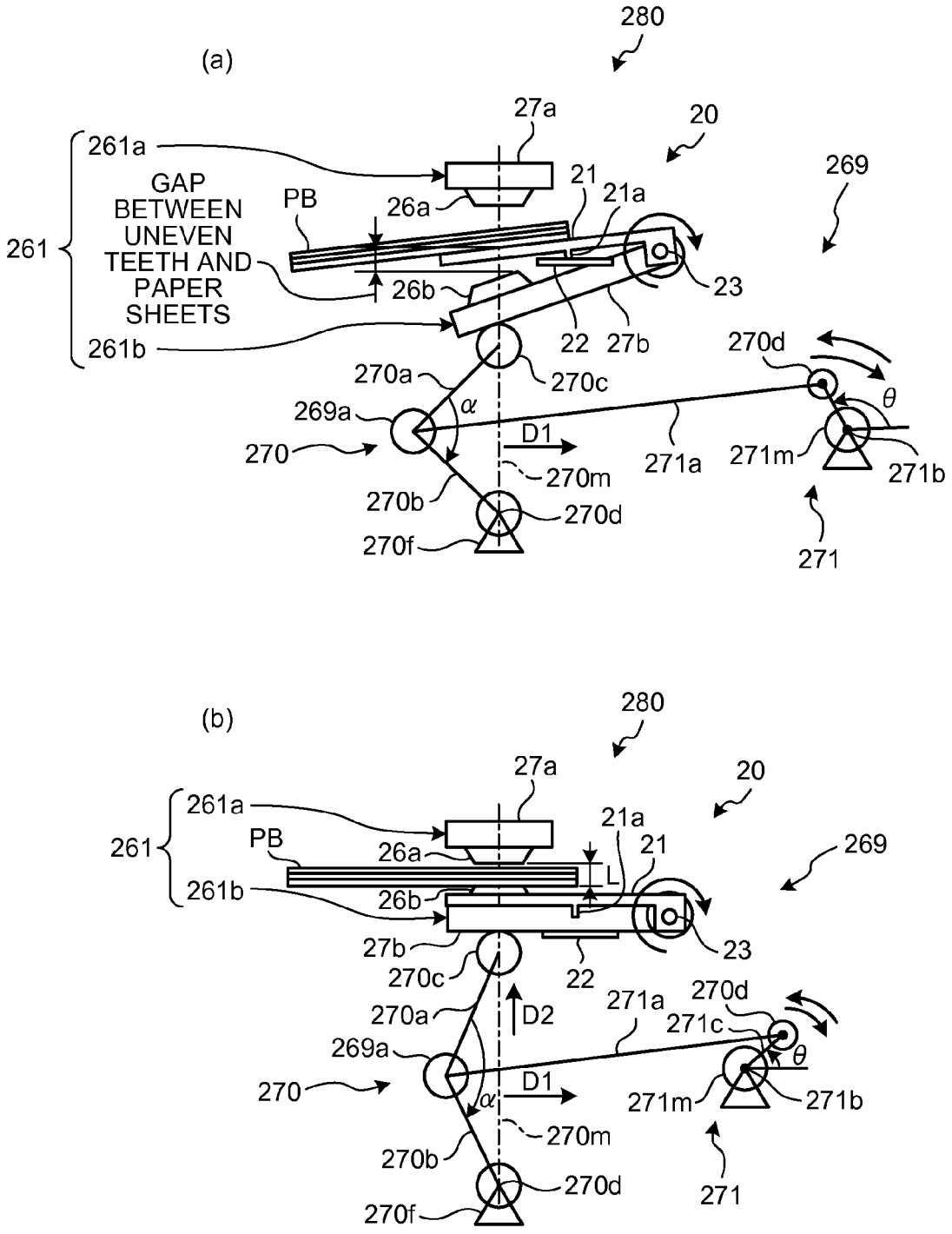
FIG. 1 is an explanatory diagram in which (a) is an explanatory diagram illustrating an example of a binding implement in the open state of tooth forms and a driving mechanism of the binding implement and (b) is an explanatory diagram illustrating an example of the binding implement in the closed state of the tooth forms and a driving mechanism of the binding implement.

The tooth forms 261 represent a pair of pressuring members that includes an upper tooth-form portion 261*a* in which uneven teeth 26*a* are disposed in a predetermined direction, and includes a lower tooth-form portion 261*b* in which uneven teeth 26*b* are disposed in a predetermined direction (see FIG. 1). Between the tooth form surfaces of the upper tooth-form portion 261*a* and the lower tooth-form portion 261*b* that face the bundle PB of paper sheets, the bundle PB of paper sheets gets sandwiched and pressured thereby resulting in pressure binding of the bundle PB of paper sheets.

Figure 5:
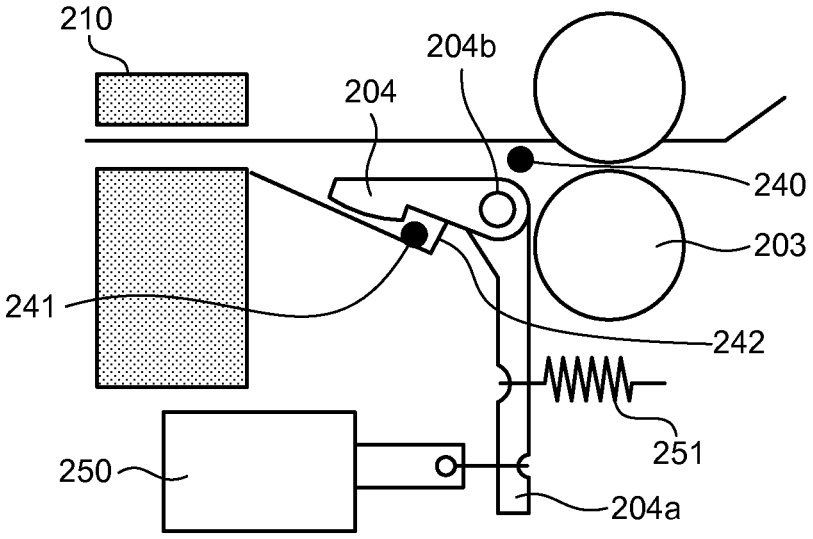
FIG. 5 is a diagram illustrating the relevant part of the paper post-processing apparatus centered on a bifurcating claw illustrated in FIG. 4 when the bifurcating claw is in a paper carrying state.
Figure 6:
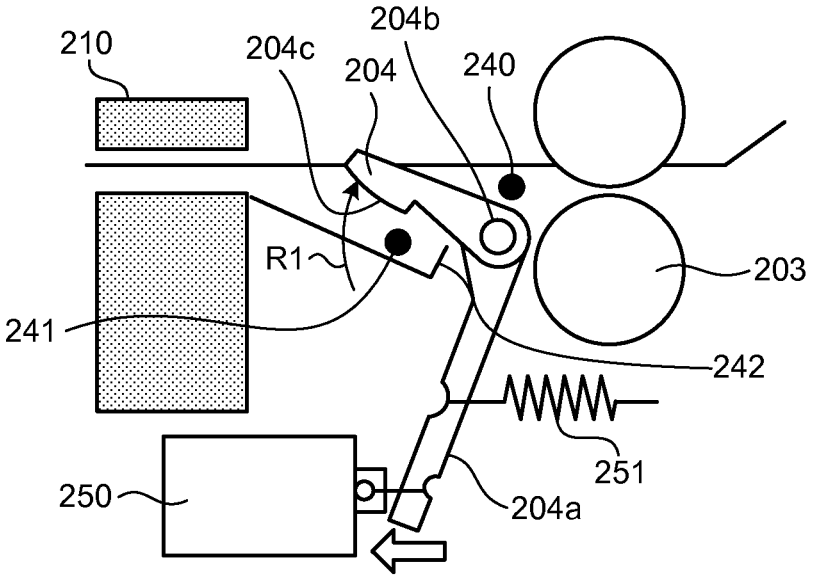
FIG. 6 is a diagram illustrating the relevant part of the paper post-processing apparatus centered on the bifurcating claw illustrated in FIG. 4 when the bifurcating claw switches a paper sheet backward.

FIGS. 5 and 6 are diagrams illustrating the relevant part of the paper post-processing apparatus 201 centered on the bifurcating claw 204. In FIG. 5 are illustrated the details when the bifurcating claw 204 is in a paper carrying state, and in FIG. 6 are illustrated the details of the related mechanism at the time of switching a paper sheet backward.

In order to switch the carrying path of a paper sheet between the carrying path 240 and the bifurcating path 241, the bifurcating claw 204 is configured to be able to oscillate with respect to a spindle 204*b* in an angular range set in advance. The bifurcating claw 204 is set at a position at which a paper sheet received from the right-hand side with reference to FIGS. 5 and 6 can be carried to the downstream side without any resistance. That is, the position of the bifurcating claw 204 illustrated in FIG. 5 is the home position. Moreover, the bifurcating claw 204 is constantly biased in an elastic manner in the counterclockwise direction with reference to FIGS. 5 and 6 by a spring 251.

The spring 251 is suspended on a bifurcating-claw movable lever 204*a* to which a plunger of a bifurcating solenoid 250 is coupled.

After a paper sheet is carried in the bifurcating path 241 in the state illustrated in FIG. 6; when the carrying surface of the bifurcating path 241 and the bifurcating claw 204 switch to the state illustrated in FIG. 5, the paper sheet present on the bifurcating path 241 can be held in a sandwiched manner.

The switching between the carrying paths is done by performing ON/OFF control of the bifurcating solenoid 250. That is, when the bifurcating solenoid 250 is turned ON, the bifurcating claw 204 rotates in the direction of an arrow R1 illustrated in FIG. 6 thereby closing the carrying path 240 and opening the bifurcating path 241. As a result, it becomes possible to guide the paper sheet into the bifurcating path 241.

FIGS. 7 to 15 are explanatory diagrams illustrating an operation of online binding performed by the binding implement 210 of the paper post-processing apparatus 201. In each of those drawings, (a) represents a planar view and (b) represents a front view.

In the first embodiment, online binding points to the following: the paper post-processing apparatus 201 is disposed at the discharge outlet of the image forming apparatus 101 as illustrated in FIG. 2, and paper sheets on which images have been formed in the image forming apparatus 101 are serially received and matched in the paper post-processing apparatus 201 followed by the binding operation.

In contrast, the paper sheets that are printed and output by the image forming apparatus 101 or the paper sheets that are printed and output separately can also be bound using the binding implement 210 of the paper post-processing apparatus 201. This binding method is called manual binding. The manual binding is not performed in succession to the discharging of paper sheets by the image forming apparatus 101. Hence, the manual binding is part of offline binding.

Figure 7:
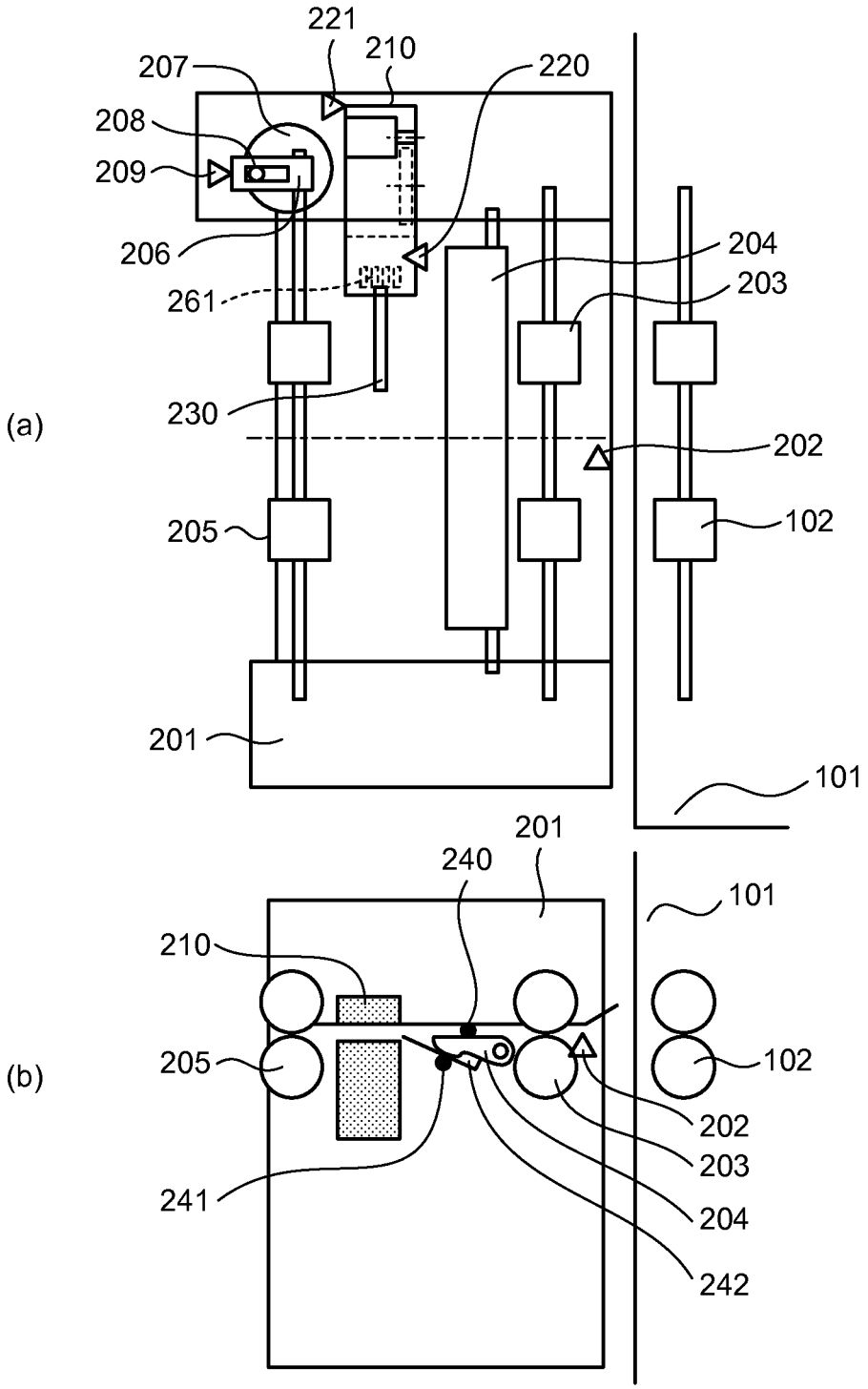
FIG. 7 is an operational explanatory diagram illustrating a state in which an initial operation during an operation of online binding is completed in the paper post-processing apparatus.

FIG. 7 is a diagram illustrating a state in which an initial operation during the operation of online binding is completed. Once paper sheets having images formed thereon start to come out from the image forming apparatus 101, the constituent elements move to the respective home positions. That marks the completion of the initial processing (operation). That state is illustrated in FIG. 7.

Figure 8:
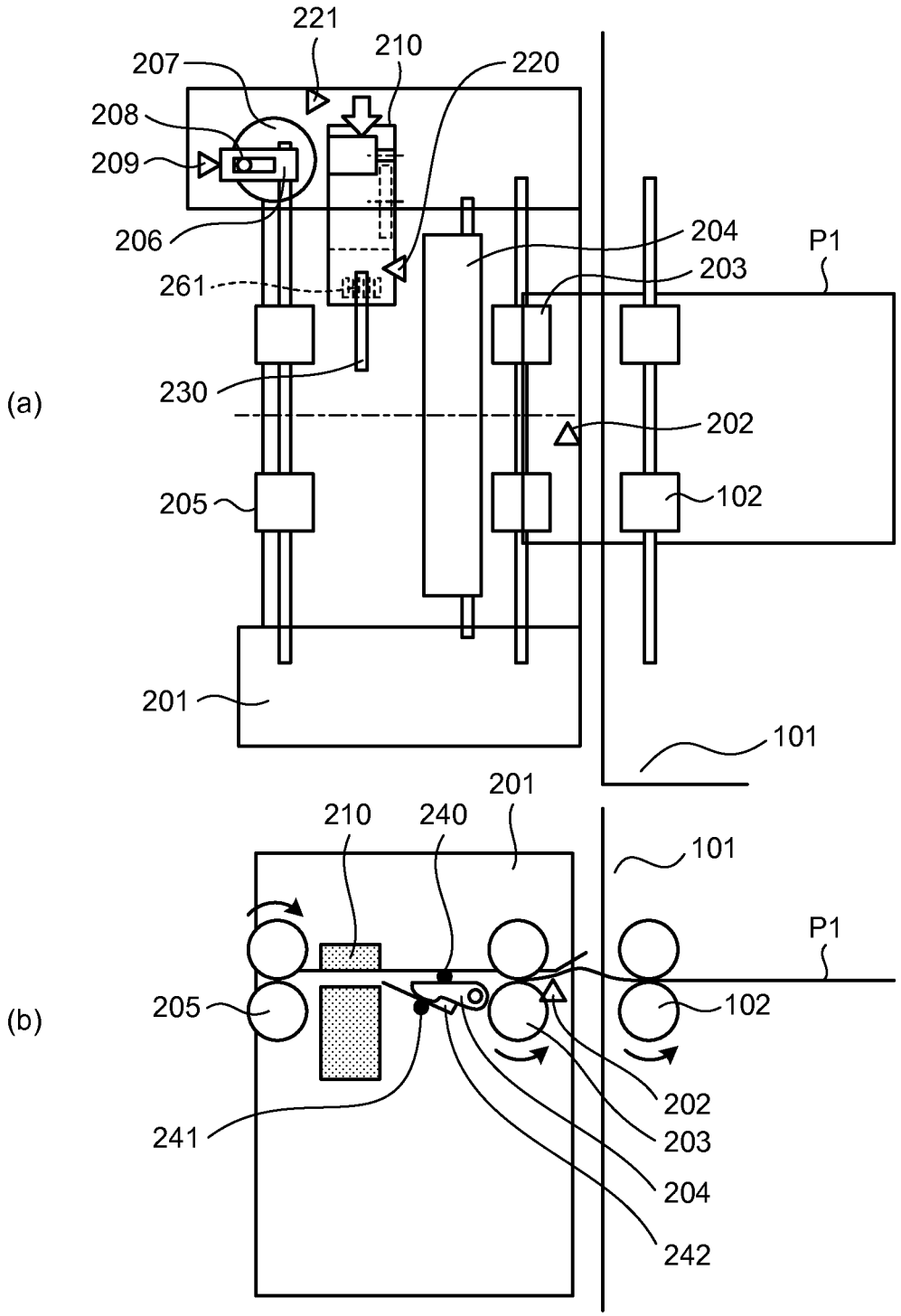
FIG. 8 is an operational explanatory diagram illustrating a state attained immediately after a first paper sheet is output from an image forming apparatus from the state illustrated in FIG. 7 and carried into the paper post-processing apparatus.

FIG. 8 is a diagram illustrating a state attained immediately after a first paper sheet P1 is output from the image forming apparatus 101 and carried into the paper post-processing apparatus 201. Before the first paper sheet P1 is carried into the paper post-processing apparatus 201 from the image forming apparatus 101, the post-processing control unit of the paper post-processing apparatus 201 receives, from a central processing unit (CPU) (not illustrated) of the image forming apparatus 101, mode information related to the control modes for paper processing and paper information. According to the received information, the paper post-processing apparatus 201 switches to a reception standby state.

The control modes include a straight mode, a shift mode, and a binding mode. In the straight mode, during the reception standby state, the entry roller 203 and the discharge roller 205 start rotating in the paper carrying direction. When the paper sheet P1 to a paper sheet Pn are carried thereto and discharged therefrom in a sequential manner, and after the last paper sheet Pn has been discharged; the entry roller 203 and the discharge roller 205 stop rotating. Meanwhile, "n" represents a positive integer equal to or greater than two.

In the shift mode, during the reception standby state, the entry roller 203 and the discharge roller 205 start rotating in the carrying direction. In a shift-discharge operation, the first paper sheet P1 is received and carried. Once the rear end of the first paper sheet P1 comes out of the entry roller 203, the shift cam 207 rotates by a certain amount and the discharge roller 205 moves in the axial direction. At that time, the first paper sheet P1 also moves along with the movement of the discharge roller 205.

Once the first paper sheet P1 is discharged, the shift cam 207 rotates and returns to the home position, thereby getting ready to carry a second paper sheet P2 that is next in line. This shift action of the discharge roller 205 is repeated until the n-th (last) paper sheet Pn of the same set of paper sheets is discharged.

As a result, the bundle PB of paper sheets of the same set (the same copy) is discharged in a shifted manner to one side, and is stacked. When the first paper sheet P1 of the next set is carried, the shift cam 207 rotates in the opposite direction to the direction of rotation taken for the previous set. Thus, the paper sheet P1 moves to the opposite side to the side of the previous set and gets discharged.

In the binding mode, during the reception standby state, the entry roller 203 is stopped and the discharge roller 205 starts rotating in the carrying direction. Moreover, the binding implement 210 moves to a standby position that is retracted by a predetermined amount with respect to the paper width, and remains there on standby. In this case, the entry roller 203 functions as a registration roller.

Thus, when the first paper sheet P1 is carried into the paper post-processing apparatus 201, the leading end of the paper sheet P1 is detected by the entry sensor 202 and butts against the nip formed at the entry roller 203. Then, the first paper sheet P1 is carried by the discharge roller 102 of the image forming apparatus 101 for a distance that further causes a certain amount of flexure from the butting position. Once the paper sheet P1 is carried for that distance, the entry roller 203 starts rotating.

As a result, the first paper sheet P1 is subjected to skew correction. The state at that time is illustrated in (a) and (b) in FIG. 8.

Figure 9:
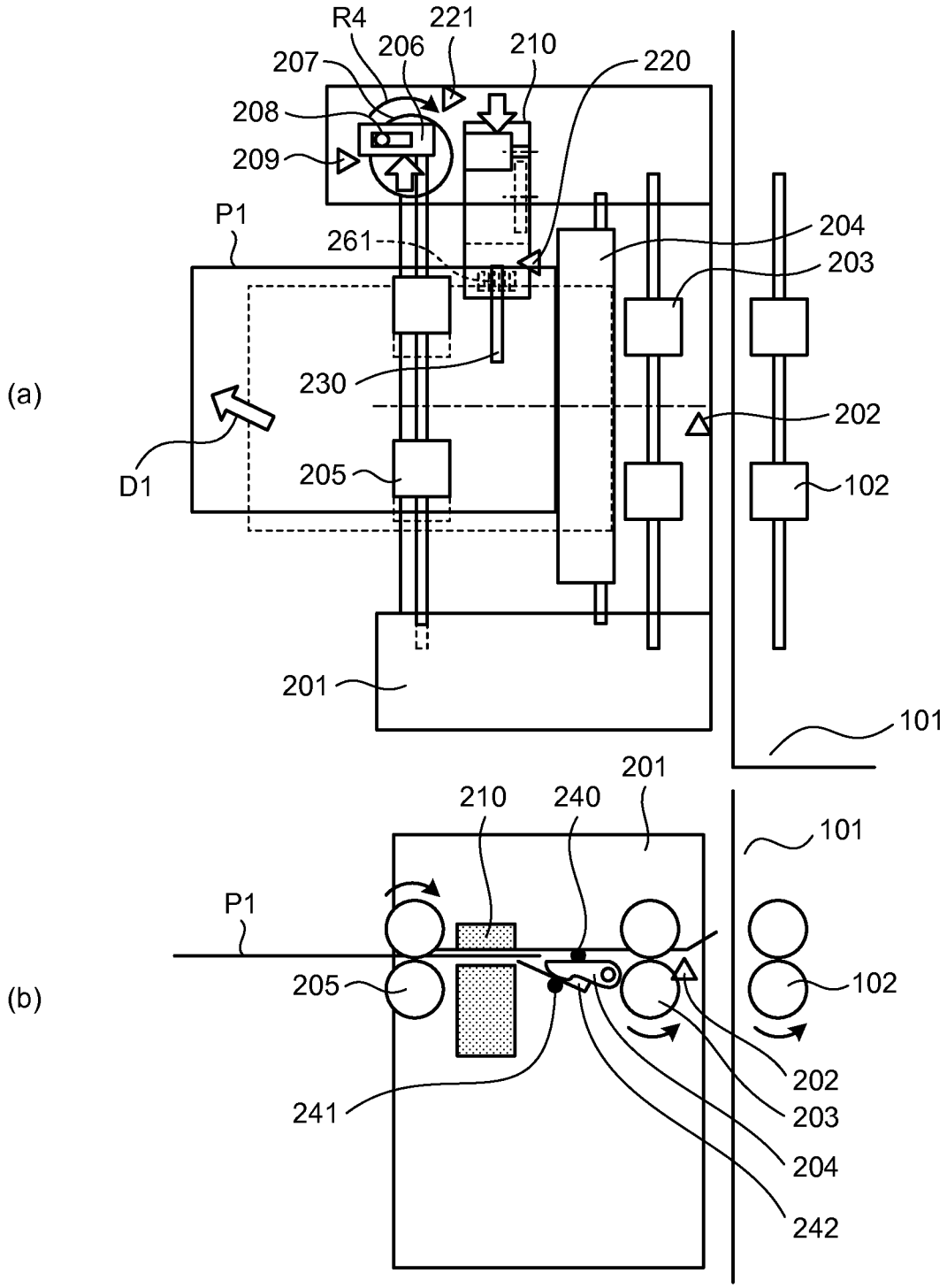
FIG. 9 is an operational explanatory diagram illustrating a state in which, from the state illustrated in FIG. 8, the rear end of the paper sheet separates from the nip of an entry roller and crosses a bifurcating path.

FIG. 9 is a diagram illustrating a state in which the rear end of a paper sheet separates from the nip of the entry roller 203 and crosses the bifurcating path 241.

The amount of carrying for the first paper sheet P1 is measured based on detection information of the rear end of the paper sheet obtained by the entry sensor 202; and position information about the paper carrying position is kept by the post-processing control unit of the paper post-processing apparatus 201.

When the rear end of the paper sheet P1 passes through the nip formed at the entry roller 203, the rotation of the entry roller 203 is stopped with the aim of receiving the second paper sheet P2 that is next in line. At that same timing, the shift cam 207 rotates in the direction of an arrow R4 illustrated in FIG. 9 (i.e., rotates in the clockwise direction with reference to FIG. 9), and the discharge roller 205 starts moving in the axial direction while nipping the first paper sheet P1. As a result, the first paper sheet P1 is carried in an oblique manner in the direction of an arrow D1 illustrated in FIG. 9.

Subsequently, when the paper end detecting sensor 220, which is placed next to or embedded in the binding implement 210, detects a side edge of the paper sheet P1; the shift cam 207 stops rotating and then rotates in the reverse direction before stopping in a state in which the paper sheet P1 is not detected by the paper end detecting sensor 220.

After that action is completed, the discharge roller 205 stops rotating at a predetermined position attained after the rear end of the paper sheet P1 has crossed the leading end of the bifurcating claw 204.

Figure 10:
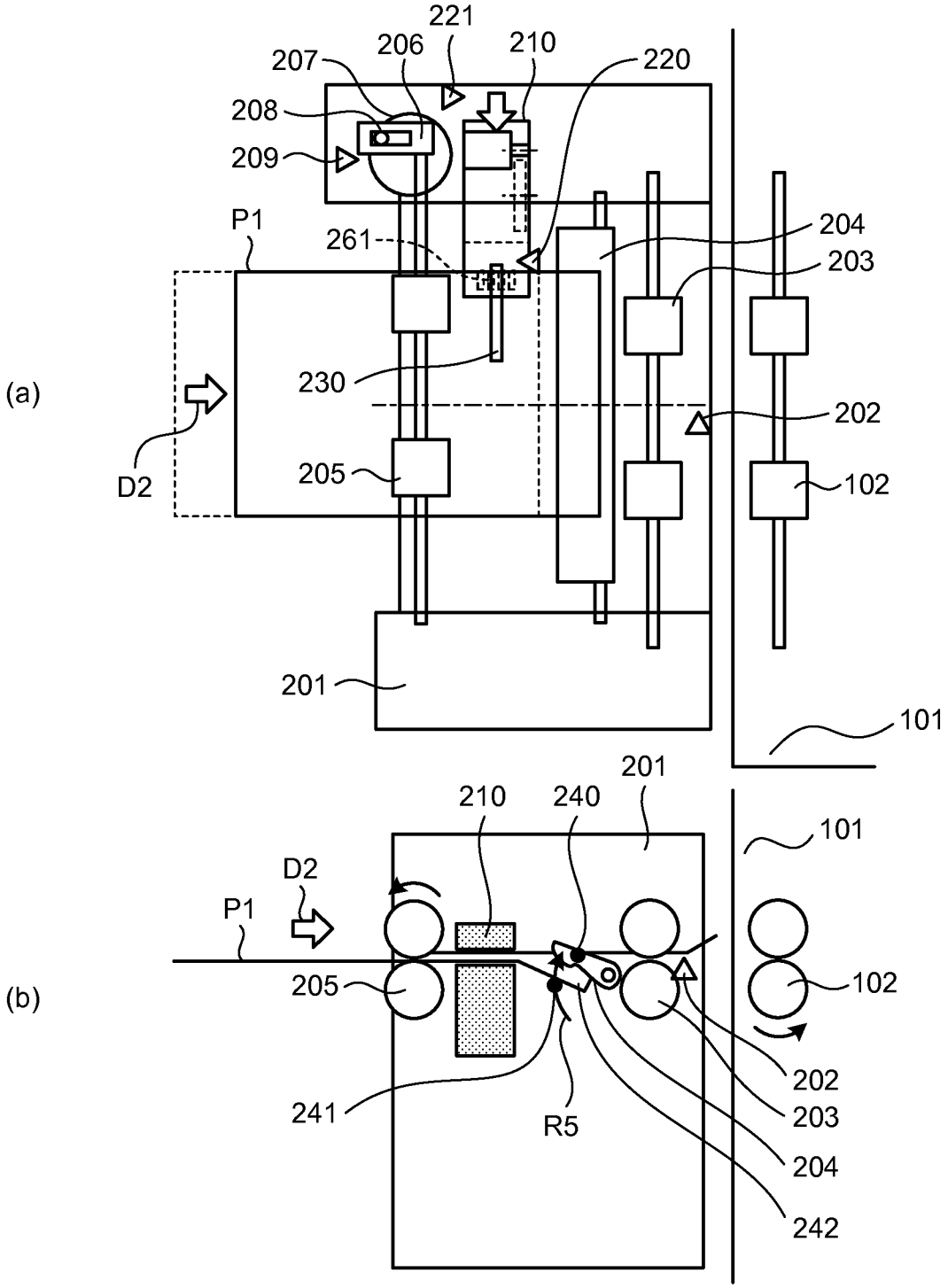
FIG. 10 is an operational explanatory diagram illustrating a state in which, from the state illustrated in FIG. 9, the paper sheet is switched back and the carrying direction thereof is matched.

FIG. 10 is a diagram illustrating a state in which the paper sheet P1 is switched back and the carrying direction thereof is matched. From the state illustrated in FIG. 9, the bifurcating claw 204 is rotated in the direction of an arrow R5 illustrated in FIG. 10 and the carrying path is switched to the bifurcating path 241. Then, the discharge roller 205 is rotated in the reverse direction.

As a result, the first paper sheet P1 is switched back in the direction of an arrow D2, and the rear end of the paper sheet P1 is carried into the bifurcating path 241 and butts against the butting surface 242. Because of the butting action, the rear end of the paper sheet P1 gets aligned with reference to the butting surface 242.

Once the first paper sheet P1 is aligned, the discharge roller 205 stops rotating. Thus, when the first paper sheet P1 butts against the butting surface 242; the discharge roller 205 slips and is not given any carrying force. That is, the setting is such that, once the first paper sheet P1 is switched back and butts against the butting surface 242 and once the rear end of the paper sheet P1 gets aligned with reference to the butting surface 242, there is no more carrying and buckling of the paper sheets.

Figure 11:
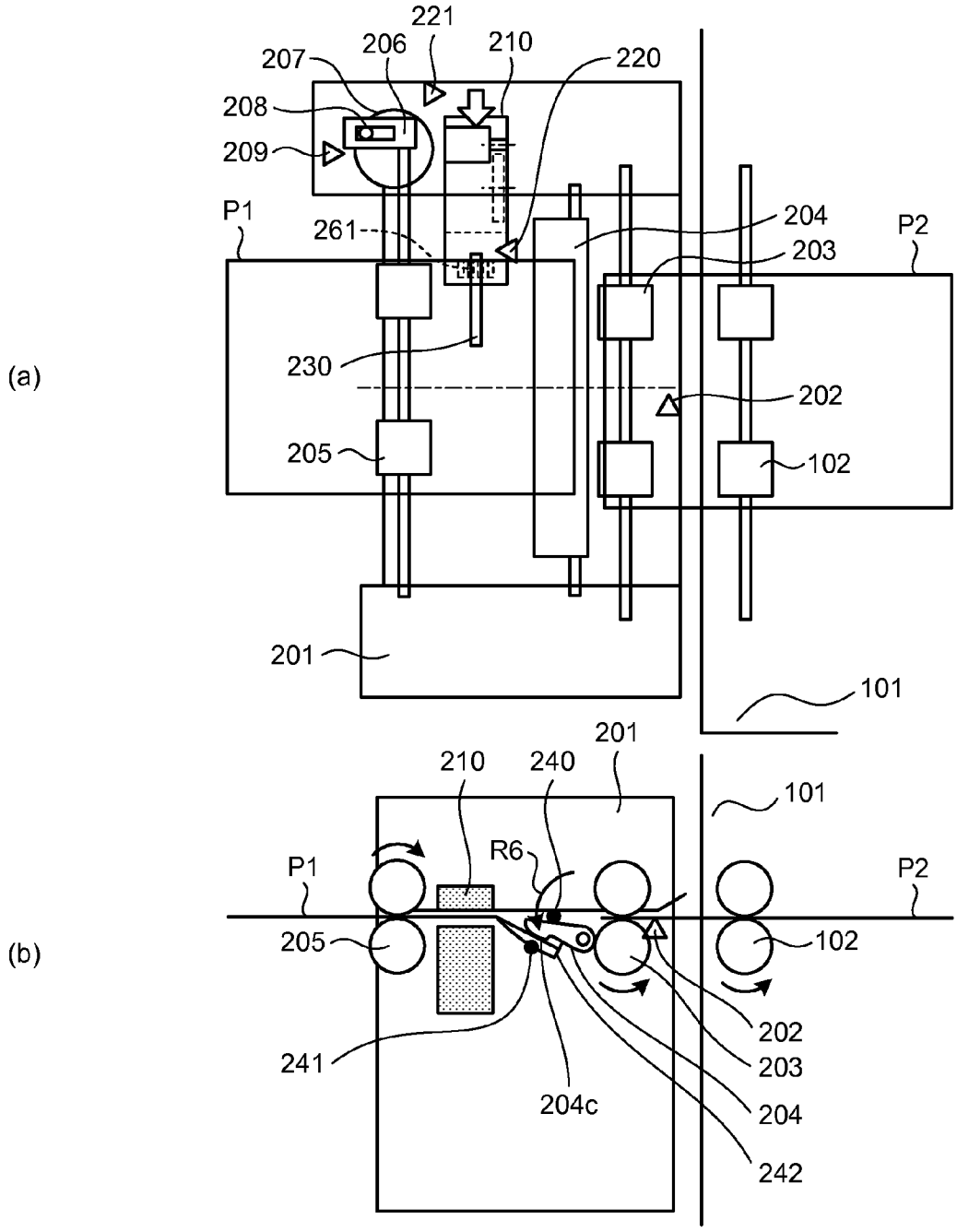
FIG. 11 is an operational explanatory diagram illustrating a state in which, from the state illustrated in FIG. 10, the first paper sheet is made to wait in the bifurcating path and the second paper sheet is carried into the bifurcating path.

FIG. 11 is a diagram illustrating a state in which the first paper sheet P1 is made to wait in the bifurcating path 241 and the second paper sheet is carried into the bifurcating path 241. After the first paper sheet P1 is aligned with reference to the butting surface 242, the bifurcating claw 204 is rotated in the direction of an arrow R6 illustrated in FIG. 11.

As a result, a contacting surface 204*c*, which is the under surface of the bifurcating claw 204, strongly presses down the rear end of the paper sheet P1, which is positioned in the bifurcating path 241, onto the surface of the bifurcating path 241. Consequently, the paper sheet P1 cannot move, and is made to wait in that state. When the second paper sheet P2, which is next in line, is carried from the image forming apparatus 101; then skew correction is performed at the entry roller 203 in an identical manner to the case of the first paper sheet P1. Then, at the same time at which the entry roller 203 starts rotating, the discharge roller 205 also starts rotating in the carrying direction.

Figure 12:
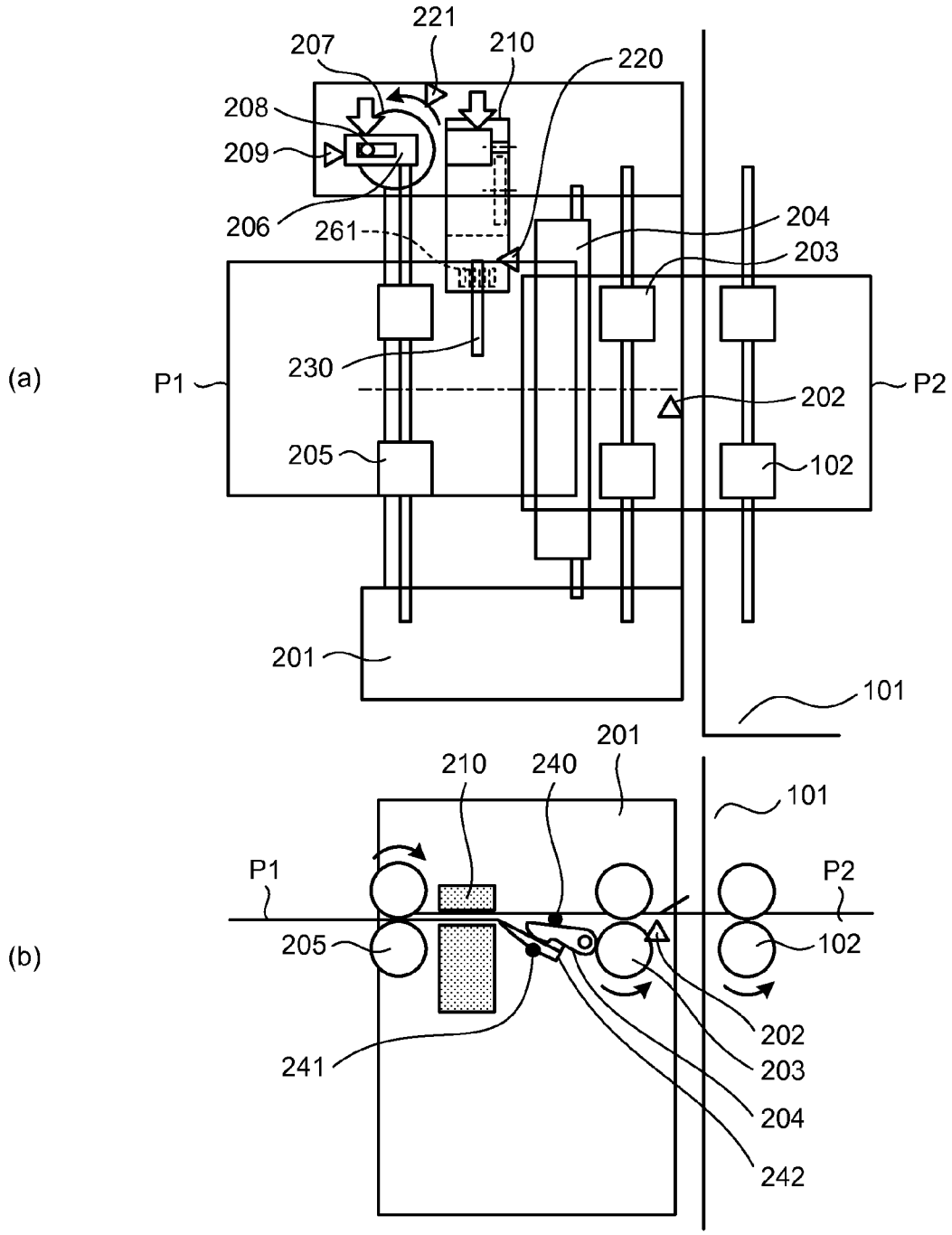

FIG. 12 is a diagram illustrating a state in which the second paper sheet P2 has been carried in. In the state illustrated in FIG. 11, when the second paper sheet P2, the third paper sheet P3, and the n-th paper sheet Pn are sequentially carried in, the operations explained with reference to FIGS. 9 and 10 are repeated. Then, the paper sheets carried sequentially from the image forming apparatus 101 are moved to a predetermined position and are matched. Subsequently, the bundle PB of paper sheets in the matched state is stacked (piled up) in the carrying path 240.

Figure 13:
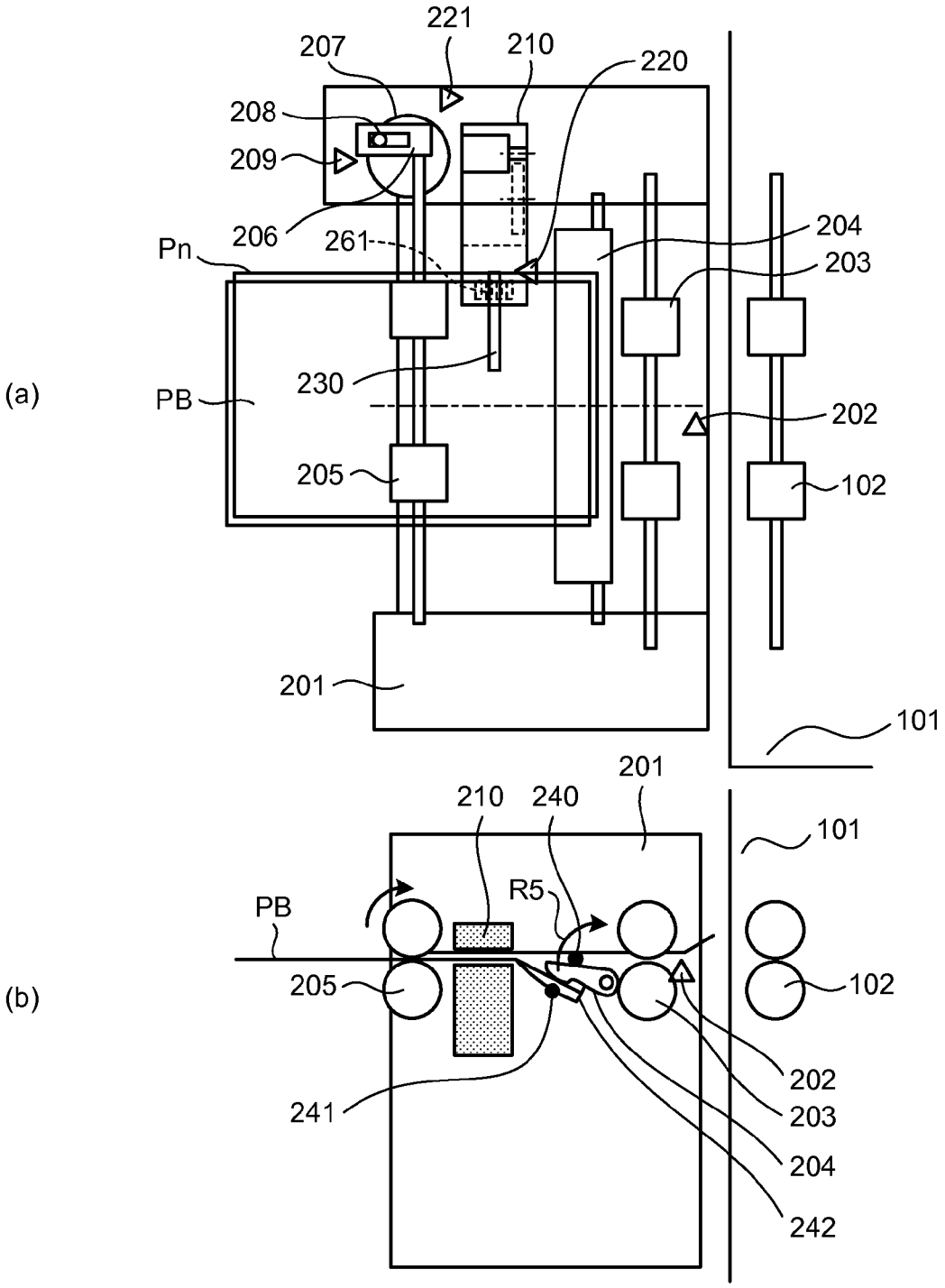
FIG. 13 is an operational explanatory diagram illustrating a state in which, from the state illustrated in FIG. 12, the last paper sheet is matched thereby resulting in the formation of a bundle of paper sheets.

FIG. 13 is a diagram illustrating a state in which the last paper sheet Pn is matched thereby resulting in the formation of the bundle PB of paper sheets. Once the bundle PB of paper sheets is formed upon matching of the last paper sheet Pn, the discharge roller 205 is rotated in the carrying direction by a certain amount and then stopped. With this operation, there is elimination of the flexure caused due to the butting of the rear end of the paper sheet against the butting surface 242.

Then, the bifurcating claw 204 is rotated in the direction of an arrow R5 illustrated in FIG. 13, and the contacting surface 204*c* is separated from the bifurcating path 241. As a result, the pressure applied on the bundle PB of paper sheet is released, and thus the binding force applied by the bifurcating claw 204 on the bundle PB of paper sheets is released. Hence, it becomes possible to use the discharge roller 205 for a carrying operation.

Figure 14:
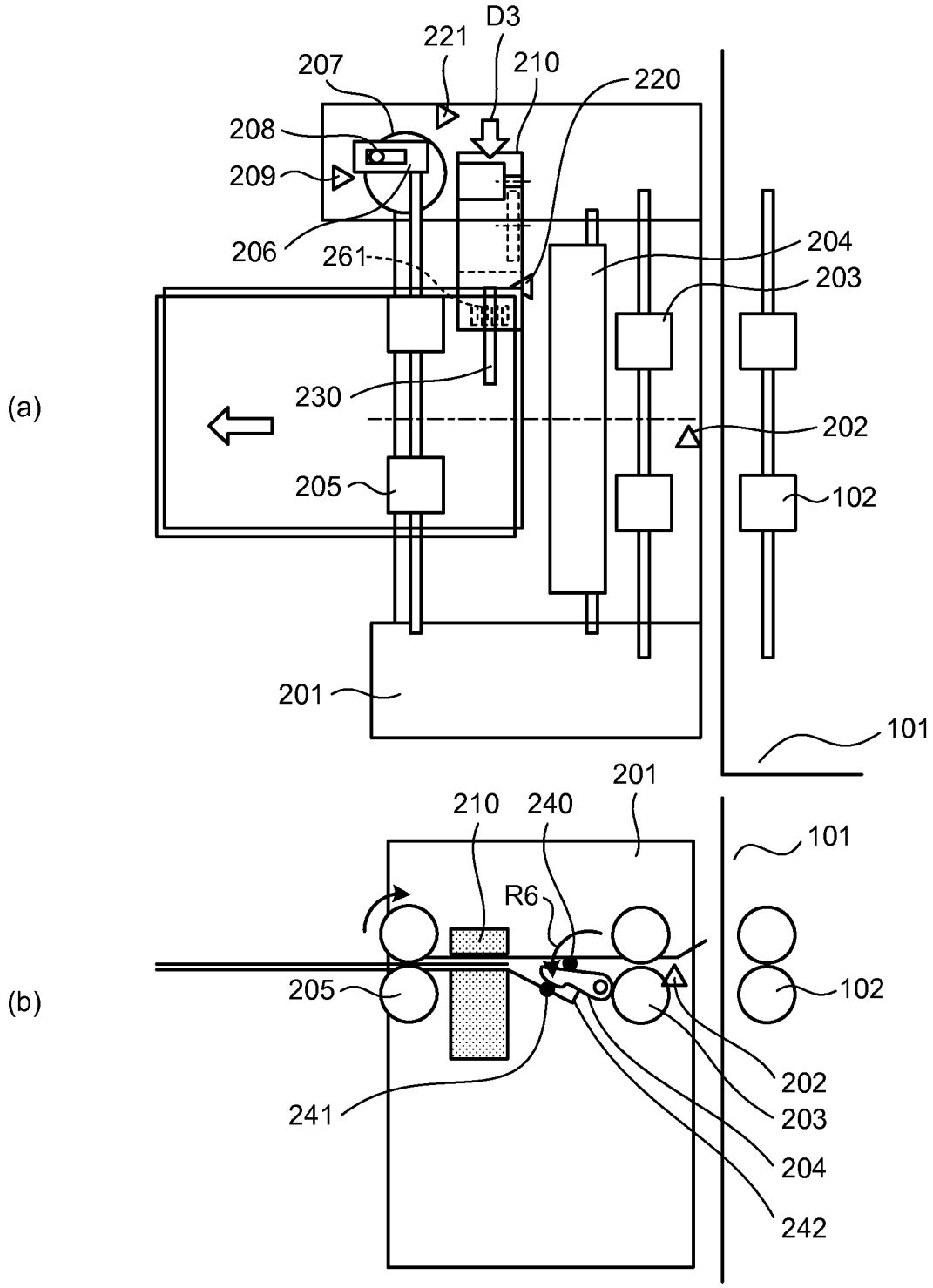
FIG. 14 is an operational explanatory diagram illustrating a state during the binding operation performed from the state illustrated in FIG. 13.

FIG. 14 is a diagram illustrating a state during the binding operation.

From the state illustrated in FIG. 13, the discharge roller 205 is rotated in the carrying direction; the bundle PB of paper sheets is carried by a distance over which the positions of the tooth forms 261 of the binding implement 210 match with the binding position of the bundle PB of paper sheets; and the bundle PB of paper sheets is stopped at that position. As a result, the processing position in the carrying direction of the bundle PB of paper sheets coincides with the positions in the carrying direction of the tooth forms 261.

Then, the binding implement 210 is moved in the direction of an arrow D3, which is illustrated in FIG. 14, by a distance over which the positions of the tooth forms 261 of the binding implement 210 match with the processing position of the paper sheets; and then the binding implement 210 is stopped. As a result, the processing position in the width direction of the bundle PB of paper sheets coincides with the positions of the tooth forms 261 in the carrying direction and in the width direction. At that time, the bifurcating claw 204 rotates in the direction of the arrow R6 illustrated in FIG. 14, and returns to the paper sheet receivable state.

Then, a driving motor 265 is switched ON; and the bundle PB of paper sheets is pressured and squeezed by the tooth forms 261 so that the bundle PB of paper sheets gets pressure-bound.

Figure 15:
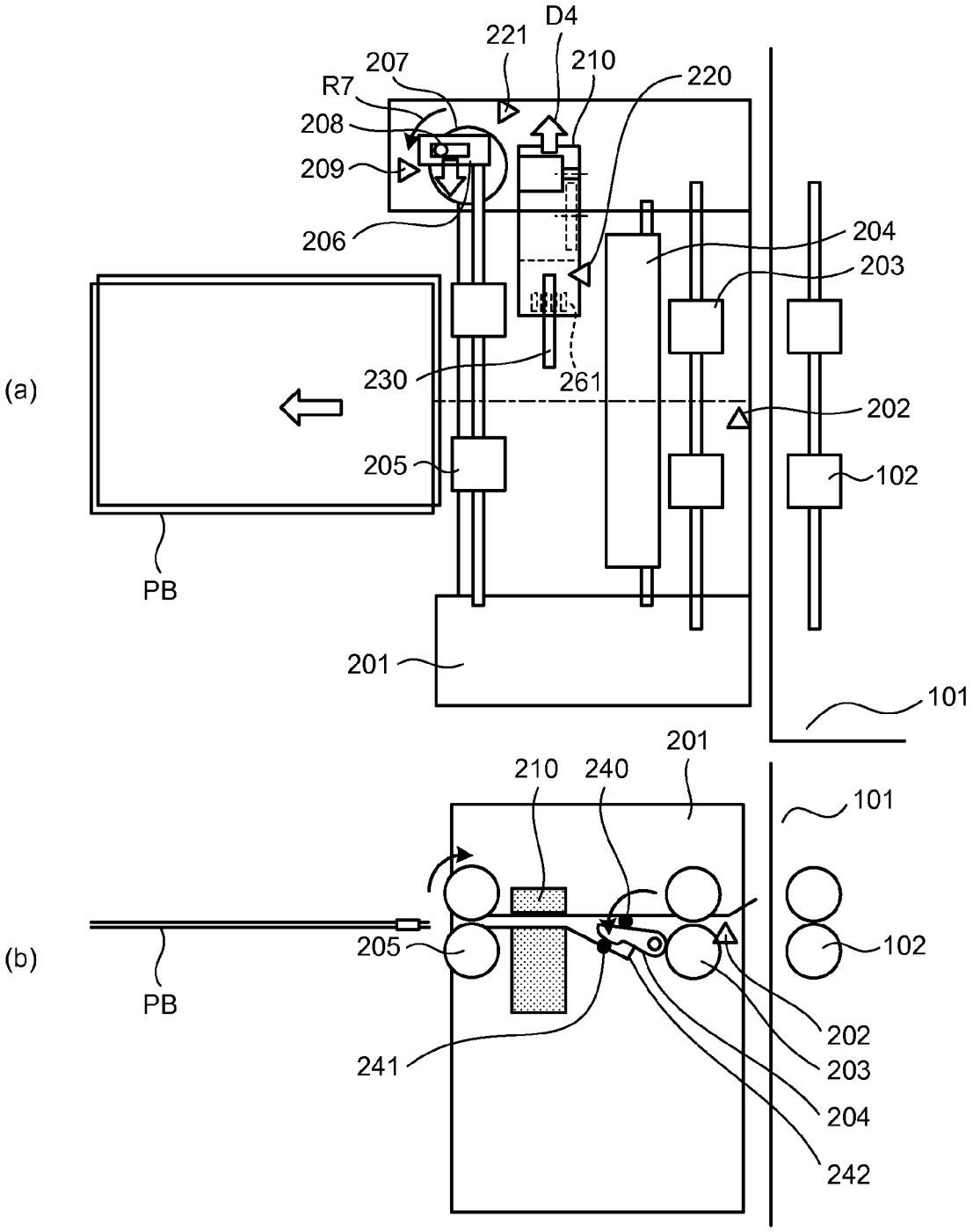
FIG. 15 is an operational explanatory diagram illustrating the state at the time of discharging the bundle of paper sheets from the state illustrated in FIG. 14.

FIG. 15 is a diagram illustrating the state at the time of discharging the bundle PB of paper sheets. Herein, the bundle PB of paper sheets that has been bound in the manner illustrated in FIG. 14 is discharged due to the rotation of the discharge roller 205.

After the bundle PB of paper sheets is discharged, the shift cam 207 is rotated in the direction of an arrow R7 and returned to the home position (i.e., to the position illustrated in FIG. 7). Along with that, the binding implement 210 is moved in the direction of an arrow D4 illustrated in FIG. 15 and returned to the home position (i.e., to the position illustrated in FIG. 7). That marks the completion of the matching operation and the binding operation of a single set (a single copy) of the bundle PB of paper sheets. If the next set of paper sheets is present, then the operations explained with reference to FIGS. 7 to 15 are repeated and a pressure-bound bundle PB of paper sheets is created.

FIG. 1 is an explanatory diagram illustrating a squeezing/pressure-bonding mechanism 269. In FIG. 1, (a) is an explanatory diagram illustrating an example of the binding implement 210 in the open state of the tooth forms 261 and a driving mechanism of the binding implement 210; and (b) is an explanatory diagram illustrating an example of the binding implement 210 in the closed state of the tooth forms 261 and a driving mechanism of the binding implement 210.

In the first embodiment, the tooth forms 261 include the upper tooth-form portion 261*a* and the lower tooth-form portion 261*b* that engage with each other. The upper tooth-form portion 261*a* is configured by disposing the uneven teeth 26*a* on the under surface of a fixed member 27*a*. The lower tooth-form portion 261*b* is configured opposite to the upper tooth-form portion 261*a* by disposing the uneven teeth 26*b* on a movable member 27*b*.

Moreover, the lower tooth-form portion 261*b* is disposed in a rotationally-movable manner around a rotary shaft 23 in such a way that the lower tooth-form portion 261*b* can move between the binding position, at which binding of the bundle PB of paper sheets is done in conjunction with the upper tooth-form portion 261*a* as illustrated in (b) in FIG. 1, and a retracted position away from the binding position as illustrated in (a) in FIG. 1.

The pressure-bonding binding device 280 illustrated in FIG. 1 includes the squeezing/pressure-bonding mechanism 269 that functions as a pressure force applying unit for moving the lower tooth-form portion 261*b* and applying a pressure force to the tooth forms 261.

The squeezing/pressure-bonding mechanism 269 includes a link mechanism 270 and a crank mechanism 271 that operates the link mechanism 270. The link mechanism 270 and the crank mechanism 271 are coupled in a rotatable manner at a first nodal point 269*a*.

The link mechanism 270 includes a first connecting rod 270*a* and a second connecting rod 270*b*. One end of each of the first connecting rod 270*a* and the second connecting rod 270*b* is coupled to the first nodal point 269*a*. Moreover, the other end of the first connecting rod 270*a* is coupled in a rotatable manner to a second nodal point 270*c*. Similarly, the other end of the second connecting rod 270*b* is coupled in a rotatable manner to a third nodal point 270*d*.

The second nodal point 270*c* is disposed on the back surface of the lower tooth-form portion 261*b*; while the third nodal point 270*d* is disposed in an unmovable manner on a fixed member 270*f* that is present on the line of extension of the reciprocating linear movement of the lower tooth-form portion 261*b* (i.e., on the line of extension of a virtual straight line 270*m*). Herein, the virtual straight line 270*m* is equivalent to the trajectory in which the lower tooth-form portion 261*b* is guided by a guide member (not illustrated).

The crank mechanism 271 includes a third connecting rod 271*a*, a driving motor 271*m*, a rotary shaft 271*b*, and a rotating rod 271*c* that is fixed to the rotary shaft 271*b* and that rotates in an integrated manner with the rotary shaft 271*b*.

One end of the third connecting rod 271*a* is coupled in a rotatable manner to the leading end of the rotating rod 271*c* and to a fourth nodal point 271*d*. The other end of the third connecting rod 271*a* is coupled in a rotatable manner to the first nodal point 269*a*. Thus, one end of the first connecting rod 270*a*, one end of the second connecting rod 270*b*, and one end of the third connecting rod 271*a* are coupled to the first nodal point 269*a*. Meanwhile, the position of the rotary shaft 271*b* of the driving motor 271*m* is fixed.

The first connecting rod 270*a* and the second connecting rod 270*b* are coupled to each other at such an angle that, when the lower tooth-form portion 261*b* is displaced to the maximum toward the upper tooth-form portion 261*a*, the first connecting rod 270*a* and the second connecting rod 270*b* do not coincide with the virtual straight line 270*m*.

In other words, the first connecting rod 270*a* and the second connecting rod 270*b* are coupled in such a way that an angle α therebetween across the first nodal point 269*a* does not become equal to 180° (equivalent to a straight line). A link having such a state of coupling is also called a "dogleg link".

The "dogleg link" means a link mechanism including the first connecting rod 270*a*, the second connecting rod 270*b*, and the first nodal point 269*a*.

In this mechanism, the third connecting rod 271*a* is coupled to the first nodal point 269*a*; and the first nodal point 269*a* is moved in the direction of the arrow D1 or in the opposite direction to the arrow D1 by the rotating rod 271*c* that is driven by the driving motor 271*m*. At that time, the constituent elements of this mechanism are disposed in such a way that the dead center of the first nodal point 269*a* in the direction of the arrow D1 reaches a position immediately before the virtual straight line 270*m*.

As a result, the first connecting rod 270*a* and the second connecting rod 270*b* do not come in alignment with each other, and are able to apply maximum pressure force at positions just before alignment. With such a configuration, the first nodal point 269*a* constantly has a vertical angle and forms a dogleg shape so to speak. Hence, it is called a "dogleg link".

In the squeezing/pressure-bonding mechanism 269 configured in the manner described above, when the driving motor 271*m* rotates in the clockwise direction with reference to FIG. 1, the third connecting rod 271*a* presses the first nodal point 269*a* in the direction of the arrow D1. As a result, the first nodal point 269*a* moves in the direction of the arrow D1, and there occurs an increase in the angle α between the first connecting rod 270*a* and the second connecting rod 270*b*.

Meanwhile, since the position of the third nodal point 270*d* is fixed, the lower tooth-form portion 261*b* moves in the direction of the arrow D2. When the lower tooth-form portion 261*b* moves toward the upper tooth-form portion 261*a* across the bundle PB of paper sheets that has been inserted in a gap L, a pressure force gets applied onto the bundle PB of paper sheets thereby resulting in pressure-bonding.

Since the binding performed using such a pressure force applying mechanism includes a squeezing operation as the operation prior to the binding operation, it is referred to as squeezing/pressure-bonding binding as mentioned earlier.

The link mechanism 270 is configured to displace the lower tooth-form portion 261*b*; and the crank mechanism 271 serves as the unit for transmitting the driving force to the link mechanism 270.

Around the region in which the first connecting rod 270*a* and the second connecting rod 270*b* extend to the maximum, the link mechanism 270 generates an extremely strong force thereby making it usable in the jack of a car. Hence, the relationship between the link mechanism 270 and the crank mechanism 271 is set in such a way that, while the link mechanism 270 is driven, the maximum force is output from the link mechanism 270 at the timing most desired by the crank mechanism 271.

Meanwhile, after binding of the bundle PB of paper sheets is done, at the time of widening the distance between teeth portions to enable pulling out the bundle PB of paper sheets from between the teeth portions, the driving motor 271*m* is rotated in the counterclockwise direction with reference to FIG. 1. Because of that, the third connecting rod 271*a* presses the first nodal point 269*a* in the opposite direction to the direction of the arrow D1 illustrated in FIG. As a result, the first nodal point 269*a* moves in the opposite direction to the direction of the arrow D1 illustrated in FIG. 1. Consequently, the angle α between the first connecting rod 270*a* and the second connecting rod 270*b* becomes narrow.

Meanwhile, since the position of the third nodal point 270*d* is fixed, the lower tooth-form portion 261*b* moves in the opposite direction to the direction of the arrow D2 illustrated in FIG. 1. That is, the lower tooth-form portion 261*b* moves in the direction away from the upper tooth-form portion 261*a*. As a result, the pressure-bonding operation is cancelled, and the gap L between the upper tooth-form portion 261*a* and the lower tooth-form portion 261*b* increases thereby making it possible to pull out the bundle PB of paper sheets from between the tooth portions.

Moreover, in the first embodiment, within the movable range of the lower tooth-form portion 261*b*, a separating mechanism 20 is disposed that, when the lower tooth-form portion 261*b* moves from the binding position to the retracted position, makes contact with the bundle PB of paper sheets and separates the bundle PB of paper sheets from the lower tooth-form portion 261*b*.

Figure 16:
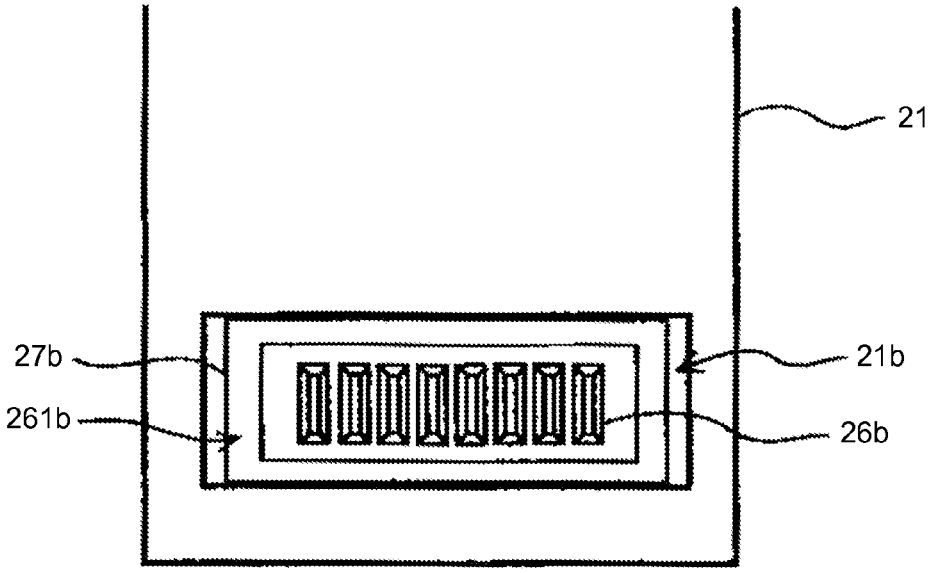
FIG. 16 is a schematic diagram illustrating a detaching member having a hole formed therein for enabling teeth to move forward as well as retract.

The separating mechanism 20 has an upper surface that serves as a contacting surface for making contact with that surface of the bundle PB of paper sheets which is facing the lower tooth-form portion 261*b*, and includes a detaching member 21 that is a plate-like member rotatable around the rotary shaft 23. As illustrated in FIG. 16, the detaching member 21 has an opening 21*b* formed thereon from which the uneven teeth 26*b* of the lower tooth-form portion 261*b* can move forward as well as retract.

The separating mechanism 20 includes a stopper 22 that makes contact with a protrusion 21*a* which is disposed on the under surface opposite to the upper surface of the detaching member 21, and thus serves as a rotation restricting member for restricting the rotational movement of the detaching member 21. When the protrusion 21*a* of the detaching member 21 and the stopper 22 make contact with each other, the stopper 22 limits the rotational movement of the detaching member 21 to a smaller range than the movable range of the lower tooth-form portion 261*b*.

Meanwhile, the rotational center of the detaching member 21 is coaxial to the rotary shaft 23 of the lower tooth-form portion 261*b*. Moreover, the detaching member 21 is configured to be rotationally-movable in tandem with the rotational movement of the lower tooth-form portion 261*b*.

When the lower tooth-form portion 261*b* moves from the retracted position to the binding position, the upper surface of the movable member 27*b* of the lower tooth-form portion 261*b* makes contact with the under surface of the detaching member 21. Then, while being pressed upward by the lower tooth-form portion 261*b*, the detaching member 21 performs rotational movement in tandem with the rotational movement of the lower tooth-form portion 261*b*.

When the lower tooth-form portion 261*b* is positioned at the binding position; in the state in which the under surface of the detaching member 21 is in contact with the upper surface of the movable member 27*b* of the lower tooth-form portion 261*b*, the teeth 26*b* of the lower tooth-form portion 261*b* protrude from the opening 21*b* of the detaching member 21. As a result, it becomes possible to bind the bundle PB of paper sheets using the pair of tooth forms 261.

Meanwhile, when the lower tooth-form portion 261*b* moves from the binding position to the retracted position, while the detaching member 21 moves due to its own weight in tandem with the movement of the lower tooth-form portion 261*b*, the protrusion 21*a* of the detaching member 21 makes contact with the stopper 22 so that the rotational movement of the detaching member 21 stops. Then, while the lower tooth-form portion 261*b* is positioned at the retracted position, the detaching member 21 remains at the position of making contact with the stopper 22.

Thus, when the lower tooth-form portion 261*b* moves from the binding position to the retracted position, the pressure-bound bundle PB of paper sheets stops on the upper surface of the detaching member 21. For that reason, the lower tooth-form portion 261*b* and the bundle PB of paper sheets are separated thereby resulting in a gap therebetween. Hence, it becomes possible to detach the bundle PB of paper sheets from the lower tooth-form portion 261*b*.

Consequently, when the bundle PB of paper sheets is released from the engagement caused due to the pair of tooth forms 261, it becomes possible to curb sticking of the bundle PB of paper sheets to the lower tooth-form portion 261*b*. Hence, it becomes possible to prevent a situation in which the bundle PB of paper sheets sticks to the lower tooth-form portion 261*b* thereby causing paper jam and damage to the paper sheets.

Meanwhile, in order to move the detaching member 21 to the position of making contact with the lower tooth-form portion 261*b* or the stopper 22, there is no need to have a separate driving source for controlling the rotational movement of the detaching member 21. For that reason, it becomes possible to prevent an increase in the size of the device and prevent the control from becoming complex.

Moreover, as illustrated in FIG. 16, the detaching member 21 has the opening 21*b* formed thereon from which the lower tooth-form portion 261*b* can move forward as well as retract. Hence, with a simple configuration and without hindering the pressure-bonding binding operation, the detaching member 21 can prevent the bundle PB of paper sheets from sticking to the lower tooth-form portion 261*b*.

Figure 17:
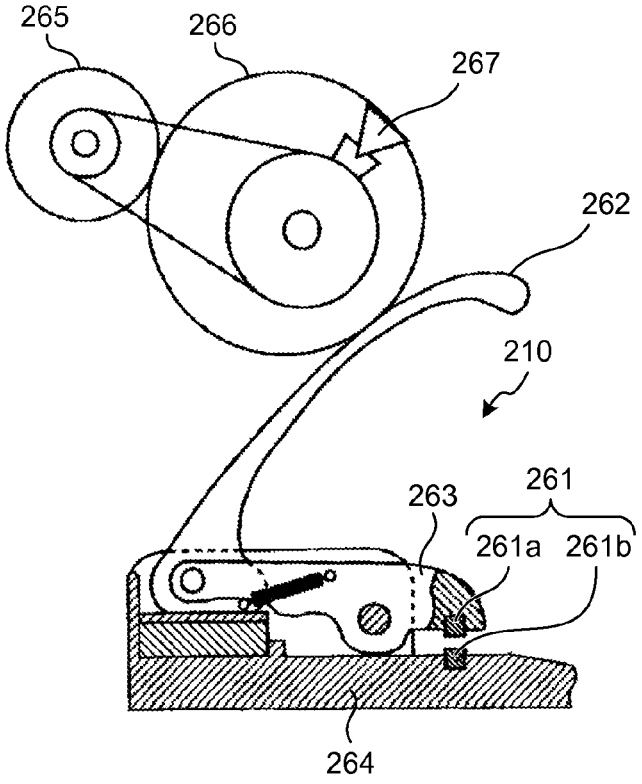
FIG. 17 is an explanatory diagram illustrating the binding implement in which the tooth forms are open and illustrating an example of the driving mechanism of the binding implement.
Figure 18:
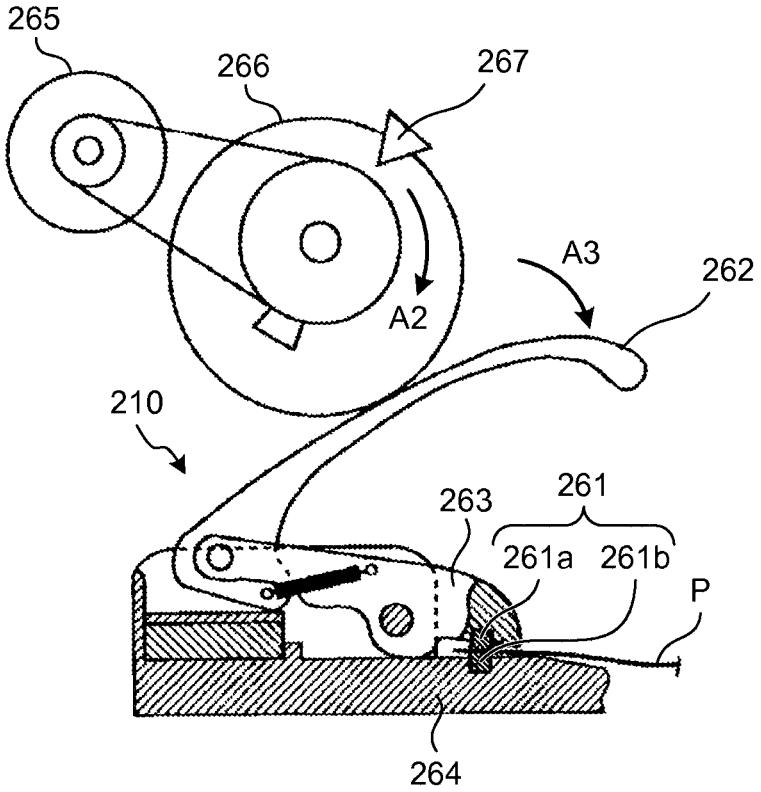
FIG. 18 is an explanatory diagram illustrating the binding implement in which the tooth forms are closed and illustrating an example of the driving mechanism of the binding implement.

FIGS. 17 and 18 are explanatory diagrams for explaining other examples of the configuration and operations of the binding implement 210. FIG. 17 is an explanatory diagram illustrating the binding implement 210 in which the tooth forms 261 are open and illustrating an example of the driving mechanism of the binding implement 210. FIG. 18 is an explanatory diagram illustrating the binding implement 210 in which the tooth forms 261 are closed and illustrating an example of the driving mechanism of the binding implement 210.

With reference to FIG. 17, the tooth forms 261 include the upper tooth-form portion 261*a* and the lower tooth-form portion 261*b* that engage with each other. The upper tooth-form portion 261*a* is assembled at the leading end of a movable link member 263.

The lower tooth-form portion 261*b* is assembled to a fixed link member 264 in such a way that the lower tooth-form portion 261*b* is positioned opposite to the upper tooth-form portion 261*a*.

The movable link member 263 is configured in such a way that the revolution of a pressure lever 262 makes the tooth forms 261 to come in contact with each other and separate from each other.

Due to a cam 266 that rotates in the direction of an arrow A2 illustrated in FIG. 18, the pressure lever 262 revolves in the direction of an arrow A3 illustrated in FIG. 18. To the cam 266 is applied a driving force from the driving motor 265. Moreover, based on detection information of a cam home-position sensor 267, the cam 266 is controlled to be positioned at the detection position.

The detection position of the cam home-position sensor 267 is set to be the home position (standby position) of the cam 266. At that position, the tooth forms 261 are in the open state.

At the time of binding the paper sheets, the operations are performed as illustrated in FIG. 18. When the pair of tooth forms 261 is in the open state, paper sheets P are inserted therebetween and the driving motor 265 is rotated so that the cam 266 is rotated in the direction of the arrow A2 illustrated in FIG. 18.

Due to the displacement of the cam surface, the pressure lever 262 revolves in the direction of the arrow A3 illustrated in FIG. 18. The torque of the pressure lever 262 increases via the movable link member 263 according to the leverage, and reaches the upper tooth-form portion 261*a* disposed at the end of the movable link member 263.

At the point of time when the cam 266 rotates by a certain amount, the upper tooth-form portion 261*a* and the lower tooth-form portion 261*b* engage with each other thereby sandwiching the paper sheets P therebetween. As a result, the paper sheets P get deformed and pressured, and the paper fiber of adjacent paper sheets gets tangled thereby resulting in binding.

Then, the driving motor 265 rotates backward, and stops at the detection position of the cam home-position sensor 267. Meanwhile, the pressure lever 262 has spring characteristics. Hence, when an excessive load is applied thereto, the pressure lever 262 undergoes flexure and lets the load get away.

In the binding implement 210 having the configuration illustrated in FIGS. 17 and 18, there occurs a change in the binding force which represents the engagement force between the pair of tooth forms 261 that sandwiches the paper sheets P in a deformed and pressured manner. Consequently, the paper fiber of the paper sheets gets tangled and the binding strength during the binding of paper sheets undergoes a change. The binding force at the time of engagement of the pair of tooth forms 261 changes according to the torque for revolving the pressure lever 262 via the cam 266, that is, according to the torque (the moment of force) generated in the driving motor 265.

The torque generated by the driving motor 265 changes according to a motor current supplied to the driving motor 265. Thus, if the motor current supplied to the driving motor 265 is controlled, then the binding force of the binding implement 210 can be varied according to a final binding mode or a temporary binding mode, and thus the binding strength against the bundle of paper sheets can be varied.

Meanwhile, with respect to the binding implement 210 having the abovementioned configuration too, the separating mechanism, which separates the bundle PB of paper sheets from the upper tooth-form portion 261*a*, can be installed within the movable range of the upper tooth-form portion 261*a*. With that, the bundle PB of paper sheets that has been pressure-bound can be prevented from sticking to the upper tooth-form portion 261*a*.

Second Embodiment

Figure 19:
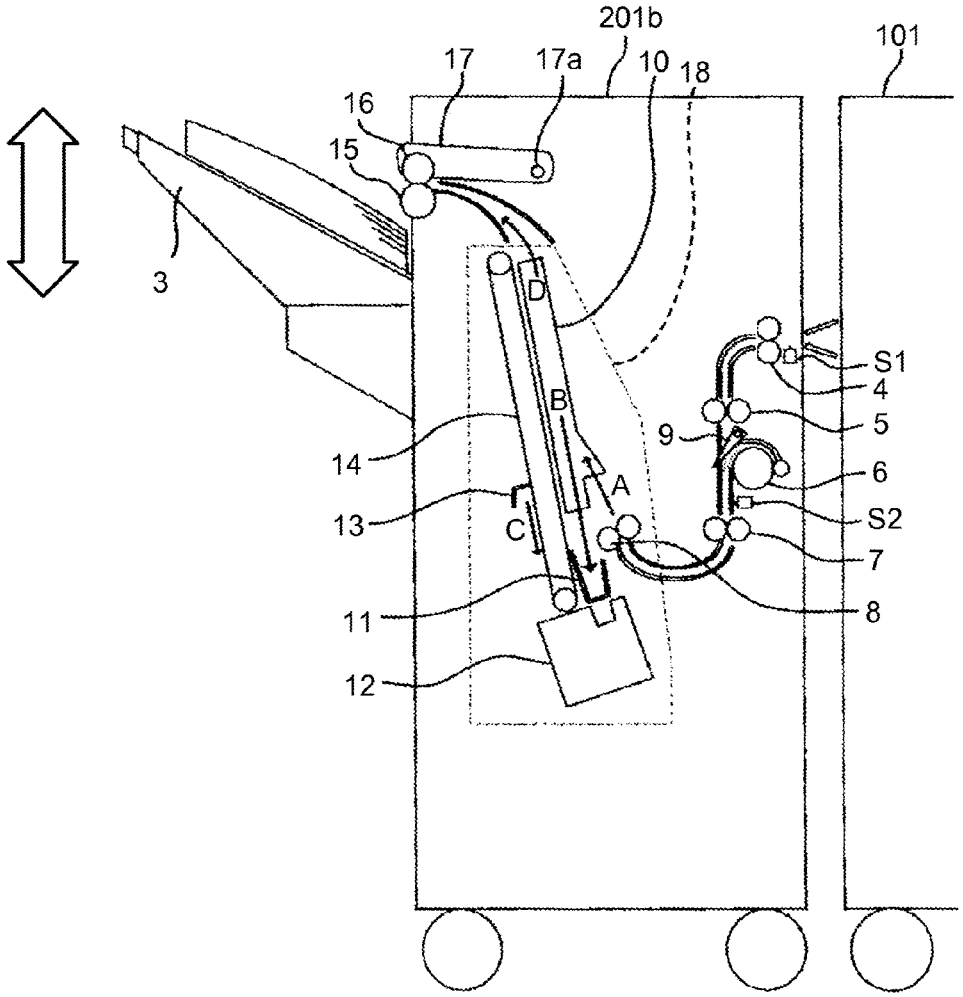
FIG. 19 is a diagram for explaining about stacking of the paper sheets in the carrying path.

FIG. 19 is a diagrammatic illustration of an image forming system that includes the image forming apparatus 101, which forms images on paper sheets, and the paper post-processing apparatus 201*b*, which performs a binding operation with respect to a bundle of paper sheets on which the image forming apparatus 101 has formed images.

Explained below with reference to FIG. 19 is the operation of stacking the paper sheets in the carrying path.

A paper sheet output from the image forming apparatus 101 enters the paper post-processing apparatus 201 and is carried by carrying rollers 4 and 5. Entering of the paper sheet is detected by a sensor S1 shown in FIG. 19. Then, due to the movement force of the paper sheet, a switching claw 9 revolves thereby securing the carrying path through which the paper sheet passes. Then, the paper sheet is carried by carrying rollers 7 and 8 to a matching unit 18.

Then, the carried paper falls down due to its own weight in the direction of an arrow B illustrated in FIG. 19 and the carrying direction of the paper sheet is matched at a rear end fence 11. Herein, the rear end of the paper sheet has been detected in advance using a sensor S2. After the period of time in which the carrying direction of the paper sheet can be matched, the width direction of the paper sheet is matched by a matching fence 10. By repeating this sequence of operations, a number of paper sheets are matched one by one.

Once the last paper sheet is matched, the bundle of matched paper sheets is subjected to pressure-bonding binding using a pressure-bonding binding device 12. Then, a releasing belt 14 in the matching unit 18 rotates in the direction of an arrow C, and a releasing claw 13 attached to the releasing belt 14 releases the bundle of paper sheets from the matching unit 18 to the direction of the arrow D. Then, that bundle of paper sheets is discharged and stacked on a tray 3 by a discharge roller 15 and a driven roller 16. The tray 3 is configured to move up and down depending on the number of stacked paper sheets.

The driven roller 16 is attached to a carrying guide plate 17; and is configured to be able to revolve around a fulcrum 17*a* so as to achieve the same carrying force regardless of the changes in the thickness of the bundle of paper sheets being carried. Moreover, the configuration is such that, due to its own weight, the fulcrum 17*a* applies a pressure to the discharge roller 15. Meanwhile, the operations explained above are performed for one set of paper sheets.

When there are two or more sets of paper sheets; in the image forming apparatus 101, the time interval for successive copying of the last paper sheet of the earlier set and the first paper sheet of the next set is same as the time interval for successive copying of the other paper sheets. Then, the paper sheets are sent to the paper post-processing apparatus 201*b*.

The operations with respect to the second set of paper sheets onward are explained with reference to (a), (b), (c), and (d) in FIG. 20.

Figure 20:
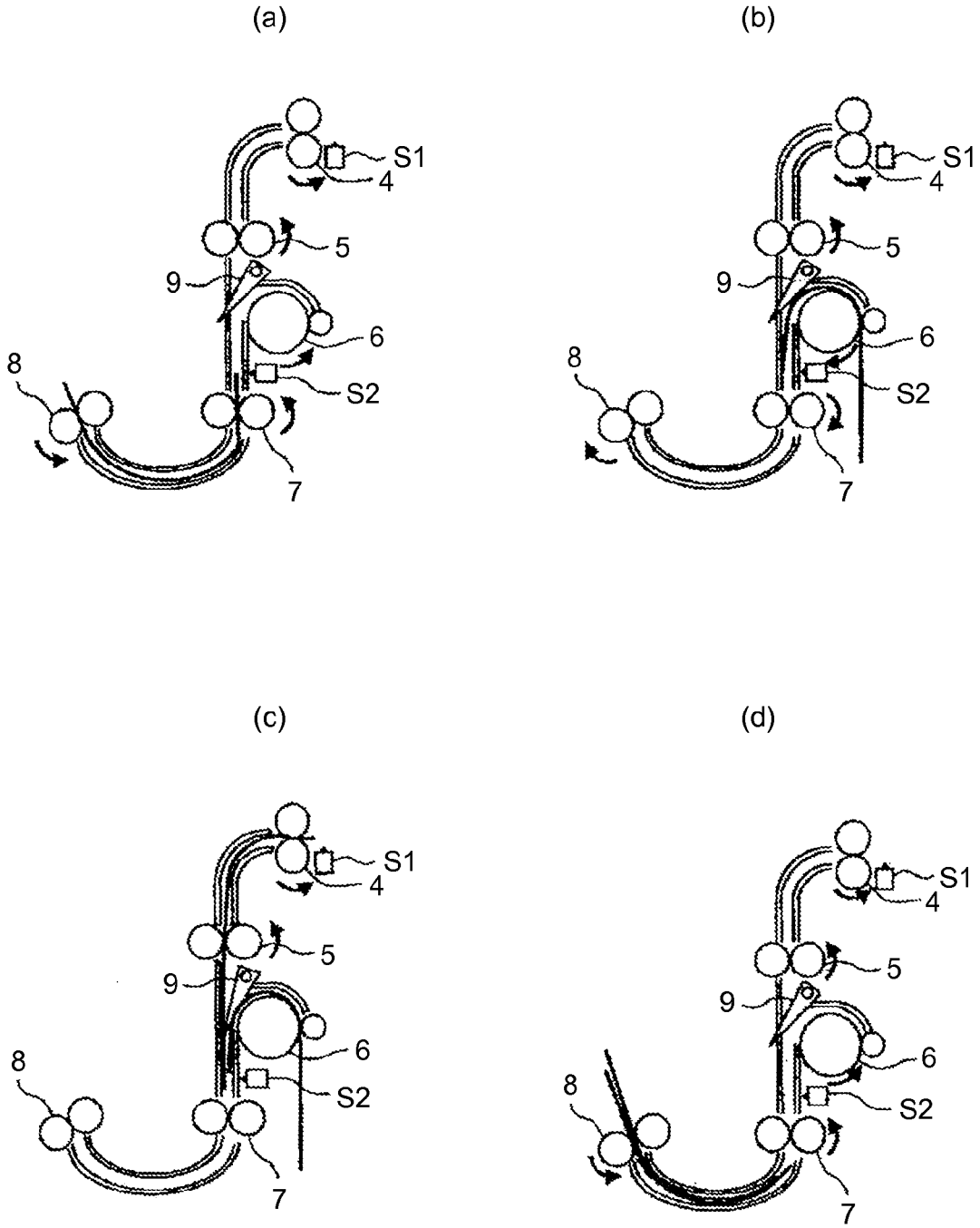
FIG. 20 is a diagram for explaining about the operations performed with respect to the second set of paper sheets onward.

The carrying rollers 4 and 5 rotate in the directions of arrows illustrated in (a) in FIG. 20 so that the first paper sheet of the second set is carried. The sensor S2 detects the rear end of that paper sheet. If the matching unit 18 is not in a condition to receive the paper sheet, then carrying rollers 6, 7, and 8 rotate backward in the directions of arrows illustrated in (b) in FIG. 20. Then, the switching claw 9 carries the paper sheet as illustrated in (b) in FIG. 20. When the end of the paper sheet is detected using the sensor S2, the carrying is stopped.

As illustrated in (c) in FIG. 20, the second paper sheet of the second set is carried by the carrying rollers 4 and 5, and the leading end of that paper sheet is detected by the sensor S2. Then, the carrying rollers 6, 7, and 8 rotate in the directions of arrows illustrated in (d) in FIG. 20, and the second paper sheet is carried in a stacked manner. When the rear end of the paper sheet is detected by the sensor S2; if the matching unit 18 is in the condition of being able to receive paper sheets, then the paper sheet is discharged as it is.

However, if the matching unit 18 is not in the condition of being able to receive paper sheets, the same operations as in the case of the first paper sheet are repeated. In this case, with respect to the second paper sheet onward in the second set, until the matching unit 18 becomes able to receive paper sheets, the same operations as in the case of the first paper sheet are repeated and then the two or more paper sheets are discharged in a stacked manner.

As a result of performing such operations, the post-processing can be performed in an efficient manner without causing any decrease in the productivity during stapling of two or more sets of paper sheets.

Meanwhile, the pressure-bonding binding device 12 according to the second embodiment can have an identical configuration to the configuration of the pressure-bonding binding device 280 according to the first embodiment. Thus, it is possible to achieve the same effect as the effect achieved when the pressure-bonding binding device 280 according to the first embodiment is used.

The explanation given above is only exemplary, and the present invention enables achieving peculiar effects for each of the following illustrative embodiments.

Illustrative Embodiment A

A paper binding device includes a pair of pressure-bonding members, such as the tooth forms 261, having uneven teeth portions; and a pressure-bonding member moving unit, such as the squeezing/pressure-bonding mechanism 269, that moves a movable pressure-bonding member, such as the lower tooth-form portion 261*b*, which represents one of the pressure-bonding members and which can move between a binding position, at which a bundle of paper sheets, such as the bundle PB of paper sheets, is bound in conjunction with the other pressure-bonding member, such as the upper tooth-form portion 261*a*, and a retracted position away from the binding position. The paper binding device, such as the pressure-bonding binding device 280, implements a pressure-bonding binding method in which the pressure-bonding member moving unit moves the movable pressure-bonding member to the binding position so that a bundle of paper sheets is sandwiched between the pair of pressure-bonding members and gets bound. The paper binding device further includes a separating unit, such as the separating mechanism 20, that is disposed within a movable range of the movable pressure-bonding member and that, when the movable pressure-bonding member moves from the binding position to the retracted position, makes contact with the bundle of paper sheets and separates the bundle of paper sheets from the movable pressure-bonding member.

In (illustrative embodiment A), when the movable pressure-bonding member moves from the binding position to the retracted position, the bundle of paper sheets that has been subjected to pressure-bonding binding can be separated and detached from the movable pressure-bonding member by the separating unit. As a result, when the engagement of the pair of pressure-bonding members across the bundle of paper sheet is released, it becomes possible to prevent the bundle of paper sheets from sticking to the movable pressure-bonding member moving from the binding position to the retracted position. Hence, it becomes possible to prevent a situation in which the bundle of paper sheets sticks to the movable pressure-bonding member thereby causing paper jam and damage to the paper sheets.

Illustrative Embodiment B

In (illustrative embodiment A), the separating unit includes a plate-like member, such as the detaching member 21, that has a contacting surface for making contact with that surface of a bundle of paper sheets which is facing the movable paper-bonding member. The plate-like member has an opening, such as the opening 21*b*, formed thereon from which the teeth portion, such as the teeth 26*b*, of the movable pressure-bonding member becomes able to move forward as well as retract. As a result, as explained in the embodiments described above, with a simple configuration and without hindering the pressure-bonding binding operation, it becomes possible to prevent the bundle of paper sheets from sticking to the movable paper-bonding member.

Illustrative Embodiment C

In a paper processing apparatus that includes at least a paper binding device for performing a binding operation with respect to a bundle of paper sheets, the paper binding device according to (illustrative embodiment A) or (illustrative embodiment B) is used. As a result, as explained in the embodiments described above, the bundle of paper sheets that has been subjected to pressure-bonding binding can be prevented from sticking to the movable pressure-bonding member. Hence, the paper binding operations can be performed in succession without causing paper jam and damage to the paper sheets.

Illustrative Embodiment D

In an image forming apparatus that includes an image forming unit which forms an image on a paper sheet, and a paper binding device which performs a binding operation with respect to a bundle of paper sheets on which the image forming unit has formed images; the paper binding device according to (illustrative embodiment A) or (illustrative embodiment B) is used. As a result, as explained in the embodiments described above, the bundle of paper sheets that has been subjected to pressure-bonding binding can be prevented from sticking to the movable pressure-bonding member. Hence, the paper binding operations can be performed in succession without causing paper jam and damage to the paper sheets.

Illustrative Embodiment E

In an image forming system that includes an image forming apparatus which forms an image on a paper sheet, and a paper binding device which performs a binding operation with respect to a bundle of paper sheets on which the image forming unit has formed images; the paper binding device according to (illustrative embodiment A) or (illustrative embodiment B) is used. As a result, as explained in the embodiments described above, the bundle of paper sheets that has been subjected to pressure-bonding binding can be prevented from sticking to the movable pressure-bonding member. Hence, the paper binding operations can be performed in succession without causing paper jam and damage to the paper sheets.

According to an aspect of the present invention, it becomes possible to prevent a bundle of paper sheets, which has been subjected to pressure-bonding binding, from sticking to a movable pressure-bonding member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper binding device comprising:

a pair of binding members that has a pair of teeth portions, and presses to bind a bundle of paper sheets;

a moving unit configured to cause one of the pair of binding members to move along with the other of the pair of binding members between a binding position at which the bundle of paper sheets is bound and a retracted position;

a separating unit configured to move and coordinate with movement of the one of the pair of binding members, and when the one of the pair of binding members moves from the binding position to the retracted position, that contacts with the bundle of the paper sheets and causes the bundle of paper sheets to separate from the one of the pair of binding members;

a restricting member configured to stop the separating unit at a restricting position between the binding position and the retracted position, when the one of the pair of the binding members moves from the binding position to the retracted position; and a contact member included in the separating unit and configured to make contact with the restricting member, the contact member extends outwardly from a surface of the separating unit.

2. The paper binding device according to claim 1, wherein the separating unit includes a plate-like member that has a contacting surface for making contact with that surface of the bundle of paper sheets which is facing the one of the pair of binding members, and the plate-like member has an opening formed thereon from which the teeth portion of the one of the pair of binding members becomes able to move forward as well as retract.

3. The paper binding device according to claim 2, wherein if one of the pair of binding members moves from the retracted position to the binding position, the restricting member does not stop the separating unit at the restricting position, and the teeth portion of the one of the pair of binding members moves forward from the opening.

4. An image forming apparatus comprising:

an image forming unit that forms an image on a paper sheet; and a paper binding device configured to perform a binding operation with respect to a bundle of paper sheets on which the image forming unit has formed an image, wherein the paper binding device is the paper binding device according to claim 1.

5. The paper binding device according to claim 2, wherein the contact member is a protrusion which is disposed on the plate-like member.

6. The paper binding device according to claim 1, wherein a rotational center of the separating unit is coaxial to a rotary shaft of the one of the pair of binding members, and the separating unit is configured to be rotationally-movable in tandem with the rotation movement of the one of the pair of binding members.

7. The paper binding device according to claim 1, wherein the contact member extends outwardly from a lower surface of the separating unit.

8. The paper binding device according to claim 1, wherein the separating unit is a plate-like member rotatable around a rotary shaft.

9. The paper binding device according to claim 1, wherein the restricting member is configured to restrict rotational movement of the separating member.

10. The paper binding device according to claim 1, wherein the contact member is on a lower surface of the separating member, opposite to an upper surface of the separating member.

11. The paper binding device according to claim 1, wherein the pair of binding members include a lower tooth-form portion and an upper tooth-form portion.

12. The paper binding device according to claim 11, wherein when the lower tooth-form portion moves from the retracted position to the binding position, an upper surface of the moving unit of the lower tooth-form portion makes contact with an upper surface of the separating unit.

13. The paper binding device according to claim 11, wherein when the lower tooth-form portion is positioned at the binding position, in a state in which an upper surface of the moving unit of the lower tooth-form portion, the teeth of the lower-tooth-form portion protrude from an opening of the separating unit.

14. The paper binding device according to claim 11, wherein when the lower tooth-form portion moves from the binding position to the retracting position, the bundle of paper sheets stops on an upper surface of the separating unit.

15. A paper binding device comprising:

a pair of binding members that has a pair of teeth portions, and presses to bind a bundle of paper sheets;

a moving unit that causes one of the pair of binding members to move along with the other of the pair of binding members between a binding position at which the bundle of paper sheets is bound and a retracted position;

a separating unit configured to move and coordinate with movement of the one of the pair of binding members, and when the one of the pair of binding members moves from the binding position to the retracted position, that contacts with the bundle of the paper sheets and causes the bundle of paper sheets to separate from the one of the pair of binding members;

a restricting member configured to stop the separating unit at a restricting position between the binding position and the retracted position, when the one of the pair of the binding members moves from the binding position to the retracted position; and a contact member included in the separating unit and makes contact with the restricting member, the contact member being a protrusion which is on the separating unit.

16. A paper binding device comprising:

a pair of binding members that has a pair of teeth portions, and configured to press so as to bind a bundle of paper sheets;

a moving unit configured to cause one of the pair of binding members to move along with the other of the pair of binding members between a binding position at which the bundle of paper sheets is bound and a retracted position;

a separating unit configured to move and coordinate with movement of the one of the pair of binding members, and when the one of the pair of binding members moves from the binding position to the retracted position, that contacts with the bundle of the paper sheets and causes the bundle of paper sheets to separate from the one of the pair of binding members;

a restricting member configured to stop the separating unit at a restricting position between the binding position and the retracted position, when the one of the pair of the binding members moves from the binding position to the retracted position; and a contact member included in the separating unit and configured to make contact with the restricting member, wherein:

the separating unit includes a plate-like member that has a contacting surface for making contact with that surface of the bundle of paper sheets which is facing the one of the pair of binding members, the plate-like member has an opening formed thereon from which the teeth portion of the one of the pair of binding members becomes able to move forward as well as retract, and the contact member is a protrusion which is disposed on the plate-like member.

17. The paper binding device according to claim 16, wherein if one of the pair of binding members moves from the retracted position to the binding position, the restricting member does not stop the separating unit at the restricting position, and the teeth portion of the one of the pair of binding members moves forward from the opening.

18. An image forming apparatus comprising:

an image forming unit that forms an image on a paper sheet; and a paper binding device configured to perform a binding operation with respect to a bundle of paper sheets on which the image forming unit has formed an image, wherein the paper binding device is the paper binding device according to claim 16.

19. The paper binding device according to claim 16, wherein a rotational center of the separating unit is coaxial to a rotary shaft of the one of the pair of binding members, and the separating unit is configured to be rotationally-movable in tandem with the rotation movement of the one of the pair of binding members.

* * * * *